US008511324B2

(12) United States Patent
Komoto et al.

(10) Patent No.: US 8,511,324 B2
(45) Date of Patent: Aug. 20, 2013

(54) WASHING/DRYING MACHINE

(75) Inventors: Nobuo Komoto, Gunma (JP); Tamotsu Kawamura, Higashioumi (JP)

(73) Assignees: Haier Group Corporation, Shandong (CN); Qingdao Haier Washing Machine Co., Ltd., Shandong (CN)

( * ) Notice: Subject to any disclaimer, the term of this patent is extended or adjusted under 35 U.S.C. 154(b) by 599 days.

(21) Appl. No.: 12/744,538

(22) PCT Filed: Nov. 28, 2008

(86) PCT No.: PCT/JP2008/071732

§ 371 (c)(1),
(2), (4) Date: May 25, 2010

(87) PCT Pub. No.: WO2009/069788

PCT Pub. Date: Jun. 4, 2009

(65) Prior Publication Data

US 2010/0251777 A1 Oct. 7, 2010

(30) Foreign Application Priority Data

Nov. 28, 2007 (JP) ..... 2007-307038

(51) Int. Cl.

| | |
|---|---|
| ***B08B 3/00*** | (2006.01) |
| ***D06F 33/00*** | (2006.01) |
| ***D06F 39/04*** | (2006.01) |

(52) U.S. Cl.

USPC ..... 134/95.2; 68/5 R; 68/12.03; 68/12.14; 68/12.15; 134/94.1; 134/95.1; 134/95.3; 134/100.1; 134/102.1; 134/102.2; 134/102.3; 134/117; 134/119; 134/157; 134/184; 134/187; 134/188; 134/189

(58) Field of Classification Search

USPC 68/5 R, 12.03, 12.14–12.15; 134/94.1–95.3, 134/100.1–102.3, 117, 119, 157, 184, 187–189

See application file for complete search history.

(56) References Cited

U.S. PATENT DOCUMENTS

| | | | | |
|---|---|---|---|---|
| 2,328,256 | A * | 8/1943 | Breckenridge | 210/212 |
| 2,434,476 | A * | 1/1948 | Wales | 68/19.2 |
| 2,555,268 | A * | 5/1951 | Chamberlin | 68/20 |
| 2,607,209 | A * | 8/1952 | Constantine | 68/20 |
| 2,892,335 | A * | 6/1959 | Gray, Jr. | 68/16 |
| 2,899,816 | A * | 8/1959 | Jacobsen, Jr. | 68/20 |

(Continued)

FOREIGN PATENT DOCUMENTS

| | | |
|---|---|---|
| JP | 2002-035492 | 2/2002 |
| JP | 2003-236290 | 8/2003 |

(Continued)

*Primary Examiner* — Arlen Soderquist

(74) *Attorney, Agent, or Firm* — Brinks Hofer Gilson & Lione

(57) ABSTRACT

A washing/drying machine according to the present invention is capable of efficiently performing a drying operation to reduce a drying period. The washing/drying machine includes a tank (11) for storing used water, and the water is circulated from the tank (11) for dehumidification of air circulated through a drying air duct (20). Since the water is circulated from the tank (11), a great amount of water can be supplied as dehumidification water for higher dehumidification efficiency. The amount of the circulated water (the amount of cooling water (dehumidification water)) is reduced in a first half of a drying process, and increased in a second half of the drying process. As a result, the drying efficiency is improved during the drying operation, thereby reducing the drying period.

9 Claims, 25 Drawing Sheets

(56) References Cited

U.S. PATENT DOCUMENTS

| | | | | |
|---|---|---|---|---|
| 3,006,176 | A * | 10/1961 | Behrens | 68/12.01 |
| 3,111,017 | A * | 11/1963 | Searle | 68/12.05 |
| 3,121,000 | A * | 2/1964 | Hubbard | 34/75 |
| 3,402,576 | A * | 9/1968 | Krupsky | 68/4 |
| 3,707,856 | A * | 1/1973 | Niewyk et al. | 68/12.03 |
| 4,765,162 | A * | 8/1988 | Ouellette | 68/20 |
| 4,903,508 | A * | 2/1990 | Durazzani et al. | 68/4 |
| 5,029,458 | A * | 7/1991 | Obata et al. | 68/19.2 |
| 5,887,456 | A * | 3/1999 | Tanigawa et al. | 68/20 |
| 6,530,245 | B1 * | 3/2003 | Kawabata et al. | 68/20 |
| 6,585,781 | B1 * | 7/2003 | Roseen | 8/149.1 |
| 7,117,612 | B2 * | 10/2006 | Slutsky et al. | 34/321 |
| 7,263,861 | B2 * | 9/2007 | Yabuuchi et al. | 68/12.15 |
| 7,380,423 | B1 * | 6/2008 | Musone | 68/20 |
| 7,490,493 | B2 * | 2/2009 | Kim et al. | 68/15 |
| 7,565,822 | B2 * | 7/2009 | Park et al. | 68/15 |
| 7,681,418 | B2 * | 3/2010 | Wong et al. | 68/5 C |
| 7,721,368 | B2 * | 5/2010 | Kim et al. | 8/158 |
| 7,797,969 | B2 * | 9/2010 | Park et al. | 68/15 |
| 7,841,219 | B2 * | 11/2010 | Wong et al. | 68/15 |
| 7,904,981 | B2 * | 3/2011 | Wong et al. | 8/149.3 |
| 7,905,120 | B2 * | 3/2011 | Mamiya et al. | 68/5 C |
| 7,913,339 | B2 * | 3/2011 | Wong et al. | 8/149.3 |
| 7,921,578 | B2 * | 4/2011 | McAllister et al. | 34/597 |
| 8,024,948 | B2 * | 9/2011 | Kitamura et al. | 68/18 F |
| 2005/0252250 | A1 * | 11/2005 | Oh et al. | 68/12.03 |
| 2006/0005581 | A1 * | 1/2006 | Banba | 68/5 R |
| 2007/0220683 | A1 * | 9/2007 | Kim | 8/158 |
| 2008/0209954 | A1 * | 9/2008 | Nakiri | 68/12.15 |
| 2008/0235977 | A1 * | 10/2008 | Kuwabara | 34/77 |
| 2008/0295547 | A1 * | 12/2008 | Finke et al. | 68/5 C |

FOREIGN PATENT DOCUMENTS

| | | |
|---|---|---|
| JP | 2004-209065 | 7/2004 |
| JP | 2006-247185 | 9/2006 |
| JP | 2007-190139 | 8/2007 |
| JP | 2007-209419 | 8/2007 |

* cited by examiner

WASHING/DRYING MACHINE

This application is the U.S. National Phase under 35 U.S.C. §371 of International Application No. PCT/JP2008/071732, filed on Nov. 28, 2008, which in turn claims the benefit of Japanese Application No. 2007-307038, filed on Nov. 28, 2007, the disclosures of which Applications are incorporated by reference herein.

TECHNICAL FIELD

The present invention relates to a washing/drying machine and, particularly, to an improvement in a drying process to be performed by the washing/drying machine.

BACKGROUND ART

A prior-art washing/drying machine having a drying function is configured such that air in a washing tub in which garment is contained is heated by circulating the air from the washing tub through a drying air duct and, for dehumidification of hot and wet air flowing out of the washing tub, water is supplied into the drying air duct and heat-exchanged with the air in a drying process (see, for example, Patent Documents 1, 2 and 3).

Patent Document 1 proposes an arrangement which includes a water-cooled dehumidifier typically requiring about 6-liter water for dehumidification, and is configured such that bathwater is supplied as dehumidification water and, when the bathwater is exhausted, the drying process is continued by using tap water (see paragraphs [0003] to [0005] in Patent Document 1).

Patent Document 2 proposes a technique of controlling the supply amount of dehumidification water to be supplied for heat exchange based on a difference between the temperature of hot air flowing out of a washing tub before the heat exchange and the temperature of the dehumidification water after the heat exchange with the hot air without excess and deficiency of the dehumidification water, while ensuring effective dehumidification (see [SUMMARY] and paragraphs [0003] to [0008] and [0020] in Patent Document 2).

Patent Document 3 proposes a technique of performing an intermittent cooling water supply control by detecting the temperature of air taken out of a washing tub and heat-exchanged with cooling water and the temperature of the cooling water after the heat exchange with the air, calculating the average of the temperatures, and supplying the cooling water for the heat exchange based on the average in order to ensure higher drying capability and reduction of the consumption of the cooling water for water saving (see [SUMMARY] and [Claim 1] in Patent Document 3).

Patent Document 1: JP-A-2002-35492
Patent Document 2: JP-A-2003-236290
Patent Document 3: JP-A-2006-247185

DISCLOSURE OF THE INVENTION

Problems to be Solved by the Invention

The prior-art washing/drying machine is configured such that the air is taken out of the washing tub in which the garment is contained, and dehumidified through heat exchange with the cooling water and heated by a heater, and then circulated back into the washing tub in the drying process. Therefore, a greater amount of cooling water (dehumidification water) is required for the dehumidification of the circulated air. Although various proposals are made mainly for the saving of the cooling water, the prior art fails to sufficiently, improve the drying efficiency.

In view of the foregoing, it is a principal object of the present invention to provide a washing/drying machine which is capable of efficiently performing a drying process, and requires a shorter period of time for the drying.

It is another object of the present invention to provide a washing/drying machine which has a drying efficiency improved by increasing a dehumidification efficiency for dehumidifying air circulated through a drying air duct in a drying process.

It is further another object of the present invention to provide a washing/drying machine which ensures easier maintenance without adhesion of lint and other foreign matter to a drying air duct after a drying process.

It is still another object of the present invention to provide a washing/drying machine which is capable of accurately determining the end of a drying operation and automatically terminating the drying operation.

It is further another object of the present invention to provide a washing/drying machine which achieves energy saving in drying operation control.

Means for Solving the Problems

According to an inventive aspect of claim 1, there is provided a washing/drying machine including: a washing tub; a tank for storing used water; a drying air duct disposed outside the washing tub and having opposite ends connected to the washing tub for use in a drying process; air blowing/heating means provided in the drying air duct for sucking air out of the washing tub through one of the opposite ends of the drying air duct, heating the sucked air and feeding the heated air back into the washing tub through the other end of the drying air duct in the drying process; a tank water circulation passage including a supply passage having opposite ends, one of which is connected to the tank and the other of which is connected to a first position of the drying air duct, and a recovery passage having opposite ends, one of which is connected to a second position of the drying air duct or the washing tub and the other of which is connected to the tank; a pump provided in the tank water circulation passage for pumping up the water from the tank through the supply passage to supply the water into the drying air duct from the first position and causing the water to fall through the drying air duct to feed the water back into the tank through the recovery passage from the second position or the washing tub to circulate the water; and control means which controls driving of the pump so as to circulate a smaller amount of water through the tank water circulation passage in a first half of the drying process and circulate a greater amount of water through the tank water circulation passage in a second half of the drying process.

According to an inventive aspect of claim 2, the washing/drying machine of claim 1 includes: a temperature sensor which detects an ambient temperature around the washing/drying machine; and tap water supply means which, when a temperature higher than a predetermined level is detected by the temperature sensor, stops the driving of the pump and supplies tap water to a predetermined position in the drying air duct.

According to an inventive aspect of claim 3, the washing/drying machine of claim 1 includes tap water supply means which stops the driving of the pump and supplies tap water to a predetermined position in the drying air duct during a cool-down operation at the end of the drying process.

According to an inventive aspect of claim 4, the washing/drying machine of claim 1 includes interruption control means which deactuates the air blowing/heating means for a predetermined period in the drying process.

According to an inventive aspect of claim 5, the washing/drying machine of claim 1 includes: an air temperature sensor provided in the drying air duct for detecting the temperature of the circulated air after heat exchange with the water supplied into the drying air duct; a water temperature sensor which detects the temperature of the water supplied into the drying air duct and heat-exchanged with the circulated air; and control means which performs a drying termination control operation based on a change in the sum of the temperatures detected by the air temperature sensor and the water temperature sensor.

According to an inventive aspect of claim 6, the washing/drying machine of claim 1 includes drain means which drains the water from the tank during a cool-down operation at the end of the drying process.

According to an inventive aspect of claim 7, the washing/drying machine of claim 1 includes: temperature detection means which detects the temperature of the air circulated through the drying air duct; and control means which controls driving of the air blowing/heating means based on the temperature detected by the temperature detection means.

According to an inventive aspect of claim 8, the control means controls the driving of the pump so that the amount of the water to be circulated through the tank water circulation passage in the first half of the drying process is great enough to be comparable with the amount of the water to be circulated through the tank water circulation passage in the second half of the drying process, if the temperature of the water contained in the tank is lower by at least a predetermined degree than a room temperature at the start of the drying process in the washing/drying machine of claim 1.

According to an inventive aspect of claim 9, there is provided a washing/drying machine including: a washing tub; a tank having a smaller internal volume for storing water used in one of a plurality of rinsing steps; a drying air duct disposed outside the washing tub and having opposite ends connected to the washing tub for use in a drying process; air blowing/heating means provided in the drying air duct for sucking air out of the washing tub through one of the opposite ends of the drying air duct, heating the sucked air and feeding the heated air back into the washing tub through the other end of the drying air duct in the drying process; a tank water circulation passage including a supply passage having opposite ends, one of which is connected to the tank and the other of which is connected to a first position of the drying air duct, and a recovery passage having opposite ends, one of which is connected to a second position of the drying air duct or the washing tub and the other of which is connected to the tank; a pump provided in the tank water circulation passage for pumping up the water from the tank through the supply passage to supply the water into the drying air duct from the first position and causing the water to fall through the drying air duct to feed the water back into the tank through the recovery passage from the second position or the washing tub to circulate the water; and control means which controls driving of the pump so as to circulate a smaller amount of water through the tank water circulation passage in a first half of the drying process and circulate a greater amount of water through the tank water circulation passage in a second half of the drying process.

According to an inventive aspect of claim 10, there is provided a washing/drying machine including: a washing tub; a tank having a smaller internal volume for storing water used in one of a plurality of rinsing steps; a drying air duct disposed outside the washing tub and having opposite ends connected to the washing tub for use in a drying process; air blowing/heating means provided in the drying air duct for sucking air out of the washing tub through one of the opposite ends of the drying air duct, heating the sucked air and feeding the heated air back into the washing tub through the other end of the drying air duct in the drying process; a tank water circulation passage including a supply passage having opposite ends, one of which is connected to the tank and the other of which is connected to a first position of the drying air duct, and a recovery passage having opposite ends, one of which is connected to a second position of the drying air duct or the washing tub and the other of which is connected to the tank; and a pump provided in the tank water circulation passage for pumping up the water from the tank through the supply passage to supply the water into the drying air duct from the first position and causing the water to fall through the drying air duct to feed the water back into the tank through the recovery passage from the second position or the washing tub to circulate the water.

Effects of the Invention

According to the inventive aspect of claim 1, the water used and stored in the tank (e.g., water used in a rinsing step preceding the drying process) is recycled and circulated for use as the water to be supplied for the dehumidification of the air circulated through the drying air duct in the drying process. Even if a greater amount of water is used, water consumption is not increased. Therefore, a necessary and sufficient amount of water can be supplied mainly for proper heat exchange without consideration of the water consumption.

According to the inventive aspect of claim 1, the control operation is performed so as to supply a smaller amount of water in the first half of the drying process and supply a greater amount of water in the second half of the drying process. In the first half of drying process, it is preferred to quickly increase the temperature of the air circulated through the drying air duct for higher drying efficiency. Therefore, the water supply amount is reduced to increase the temperature of the air circulated through the drying air duct in a shorter period of time in the first half of the drying process. In the second half of the drying process, on the other hand, the air circulated through the drying air duct is hot and wet, so that it is preferred to dehumidify the air through the heat exchange between the water and the air for higher drying efficiency. Therefore, the water supply amount is increased for proper dehumidification of the air circulated through the drying air duct, thereby promoting the drying of the garment in the second half of the drying process.

In the second half of the drying process, foreign matter such as lint and dust generated from the garment is contained in the air circulated through the drying air duct to flow through the drying air duct. The foreign matter is liable to adhere to an inner wall of the drying air duct. Therefore, it is preferred to increase the water supply amount for washing away the lint contained in the circulated air and washing away the lint and other foreign matter adhering to the inner wall of the drying air duct.

In the second half of the drying process, efficient heat exchange can be achieved by increasing the amount of the water circulated through the tank water circulation passage and, at the same time, changing the flow rate of the air circulated through the drying air duct. In addition, the capability of removing lint and other foreign matter contained in the air (washing-away capability) can be improved.

Where the washing/drying machine is used at a higher ambient temperature (room temperature), the temperature of the recycling water stored in the tank is likely to rise, leading to inefficient heat exchange between the recycling water and the air. According to the inventive aspect of claim 2, the tap water is used instead of the recycling water stored in the tank for the dehumidification of the circulated air, if the ambient temperature detected by the temperature sensor is higher than the predetermined level. Since the temperature of the tap water is lower than the temperature of the recycling water stored in the tank, efficient heat exchange can be achieved to properly maintain the drying capability.

According to the inventive aspect of claim 3, the tap water is supplied, instead of the recycling water stored in the tank, into the drying air duct during the cool-down operation at the end of the drying process. During the cool-down operation, therefore, the air circulated through the drying air duct is quickly cooled by the tap water, and the temperature of the garment in the washing tub is cooled by the cooled circulated air. Thus, the cool-down operation can be efficiently performed, thereby reducing the time required for the drying process.

According to the inventive aspect of claim 4, the air blowing/heating means is deactuated for a predetermined period in the drying process. This prevents the air blowing/heating means from suffering from reduction in operation reliability, which may otherwise occur when the air blowing/heating means is heated to a higher temperature due to continuous operation thereof.

Where the air blowing/heating means is temporarily deactuated, the circulation of the air through the drying air duct is stopped. This eliminates the possibility that air not heated by the heating means is circulated through the drying air duct, so that the washing/drying machine is substantially free from deterioration of the drying capability.

According to the inventive aspect of claim 5, the end of the drying operation is determined based on the sum of the temperatures detected by the air temperature sensor and the water temperature sensor (a value obtained by addition of the detected temperatures). Therefore, the end of the drying operation can be accurately determined.

An exemplary method for the determination of the end of the drying operation based on the change in the sum of the temperatures detected by the air temperature sensor and the water temperature sensor is as follows. A value of the sum of temperatures detected by the air temperature sensor and the water temperature sensor in the first half of the drying process is stored. In the second half of the drying process, the temperatures detected by the air temperature sensor and the water temperature sensor are monitored and, when the sum of the detected temperatures increases by at least a predetermined degree from the previously stored value of the sum, the end of the drying operation is determined.

According to the inventive aspect of claim 6, the water is drained from the tank during the cool-down operation. Therefore, the used water does not remain in the tank after completion of the drying process, so that the washing/drying machine is clean without generation of odors. Where the washing/drying machine is used in a cold region, the washing/drying machine is free from the freezing of the water remaining in the tank.

According to the inventive aspect of claim 7, the temperature increase of the air circulated through the drying air duct due to overheating of the air can be suppressed without impairment of the drying capability. Where the temperature of the air circulated through the drying air duct is excessively increased, heating means (e.g., a heater) may be stopped. Where air blowing means (e.g., a blower) is kept driven, however, lower temperature air would flow into the washing tub, thereby impairing the drying capability. According to the inventive aspect of claim 7, the driving of the heating means and the air blowing means are simultaneously controlled, whereby the temperature of the circulated air is kept at a predetermined temperature level or higher. Thus, an energy saving operation can be performed substantially without the impairment of the drying capability.

According to the inventive aspect of claim 8, if the temperature of the water stored in the tank (water temperature) is lower by at least the predetermined degree than the room temperature at the start of the drying process (e.g., (tank water temperature)≦(room temperature)−5° C.), a dehumidification effect provided by increasing a difference between the temperature of the air circulated through the drying air duct and the temperature of the water (dehumidification water) supplied to the drying air duct is more effective for the drying than the effect of reducing the time required for increasing the temperature of the air circulated through the drying air duct by reducing the amount of the water circulated through the tank water circulation passage. Therefore, a greater amount of water is circulated to be supplied into the drying air duct. This reduces the drying process time and the power consumption. Even in the first half of the drying process, the amount of lint, dust and other foreign matter adhering to the drying air duct can be reduced to improve the reliability by increasing the amount of the water circulated through the tank water circulation passage.

The inventive aspect of claim 9 provides the same effects as the inventive aspect of claim 1 and, in addition, makes it possible to reduce the internal volume of the tank in which the used water is stored (e.g., to about 8.5 liters). By employing the smaller volume tank, size increase of the overall washing/drying machine is suppressed. The tank has a smaller internal volume that is necessary and sufficient to continuously circulate the water through the tank water circulation passage without the need for storing the water in an amount greater than necessary.

The inventive aspect of claim 10 provides the same effects as the inventive aspect of claim 9 and, in addition, makes it possible to use a smaller volume tank for the washing/drying machine. Since the air is dehumidified through the heat exchange by circulating the water from the smaller volume tank in the drying process, the size increase of the overall washing/drying machine can be suppressed.

DESCRIPTION OF REFERENCE CHARACTERS

Figure 1:
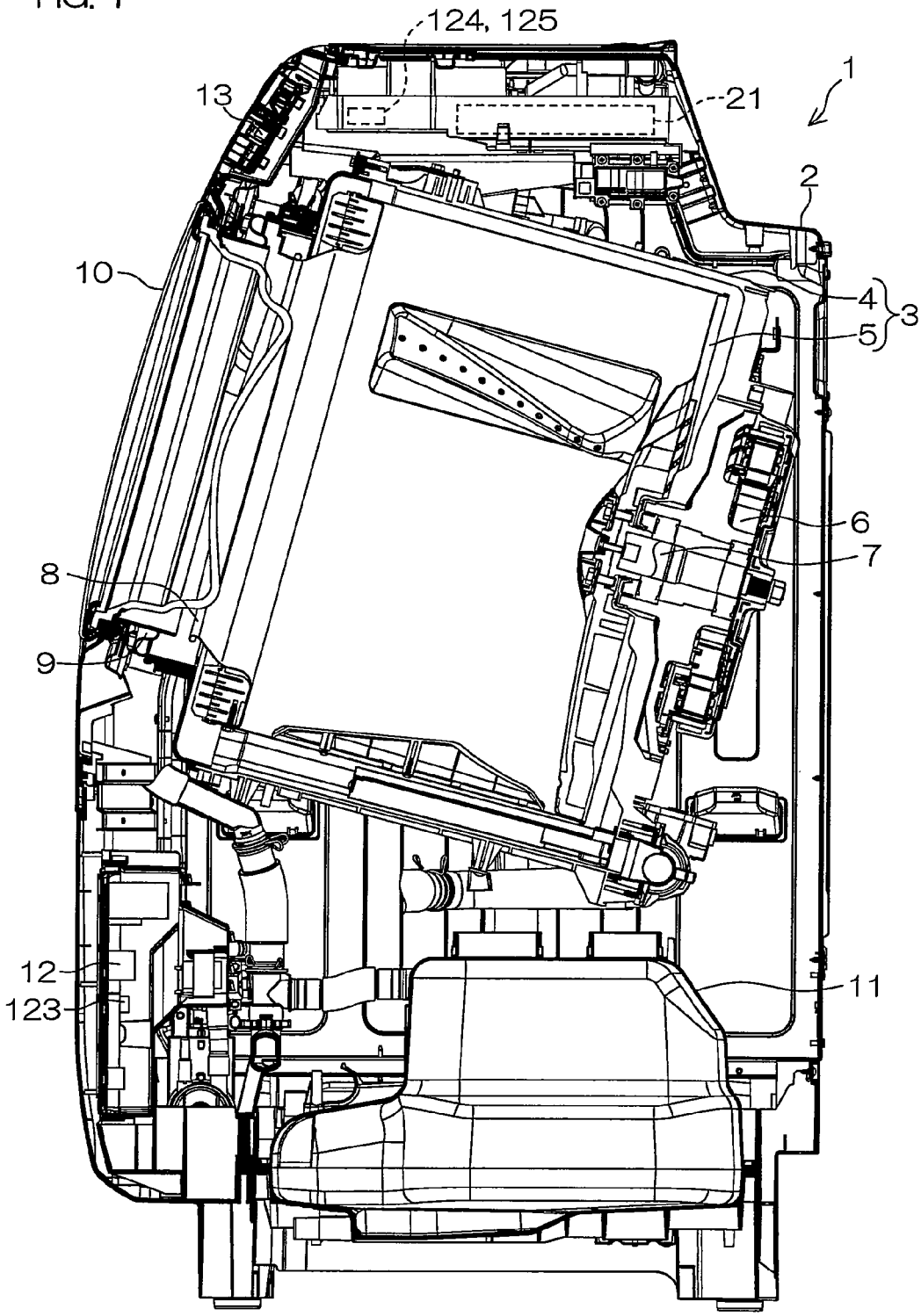
FIG. 1 is a right side view illustrating, in vertical section, a washing/drying machine 1 according to one embodiment of the present invention.

1: Washing/drying machine
3: Washing tub
4: Outer tub
5: Drum
11: Tank
15: Filter unit
17: Water supply valve
19: Ozone generator
20: Drying air duct
21: Blower
23: Drying pump
25: Circulation pump
26: U-turn portion
27: Gas-liquid mixer
48: Second drain valve
57: Second water circulation passage
58: Venturi tube
59: Third water circulation passage
77: Restrictive flow passage
81: Check valve
83: Filter body
85: Operable lid
86: Smaller filtering holes
90: Recycling water filtering wall portion
101: Cover
103: Movable member
111: Gravity center adjusting member
112: Stopper projection
120: Control section
121: Drum outlet temperature sensor
122: Dehumidification water temperature sensor
123: Board temperature sensor
124, 125: Drying heaters
126: Blower motor
150: Case

BEST MODE FOR CARRYING OUT THE INVENTION

The construction of a washing/drying machine of a so-called oblique drum type according to one embodiment of the present invention will hereinafter be described specifically with reference to the drawings.

Construction and Operation of Washing/Drying Machine

FIG. 1 is a right side view illustrating, in vertical section, the washing/drying machine 1 according to one embodiment of the present invention. The washing/drying machine 1 includes a washing tub 3 disposed obliquely in a housing 2. The washing tub 3 includes an outer tub 4 in which water is retained in a laundry process, and a drum 5 rotatably accommodated in the outer tub 4. The drum 5 is rotated about a rotation shaft 7 by a DD motor 6 provided rearward of the outer tub 4. The rotation shaft 7 extends obliquely upward toward the front to provide a so-called oblique drum structure. An opening 8 of the drum 5 and an opening 9 of the outer tub 4 are covered and uncovered with a round door 10 attached to the housing 2. With the door 10 being opened, garment (laundry) is loaded into and unloaded from the drum 5 through the openings 8, 9.

One feature of this washing/drying machine 1 is that a tank 11 is provided below the washing tub 3 for storing used water (recycling water). The tank 11 has an internal volume of about 8.5 liters. As will be described later, water used for a rinsing operation is stored in the tank 11, and is used as heat-exchange water and cleaning water for removing lint and the like from an air circulation duct in a drying process.

An electrical component 12 including a main control board is provided in a lower front portion of the housing 2, and an electrical component 13 for display and input operation is provided in an upper front portion of the housing 2. The lower electrical component 12 includes a board temperature sensor 123 to be described later.

Further, a blower 21 to be driven in the drying process to be described later, and a drying heater A124 and a drying heater B125 for heating air circulated into the washing tub 3 by the blower 21 are provided in an upper portion of the housing 2.

Figure 2:
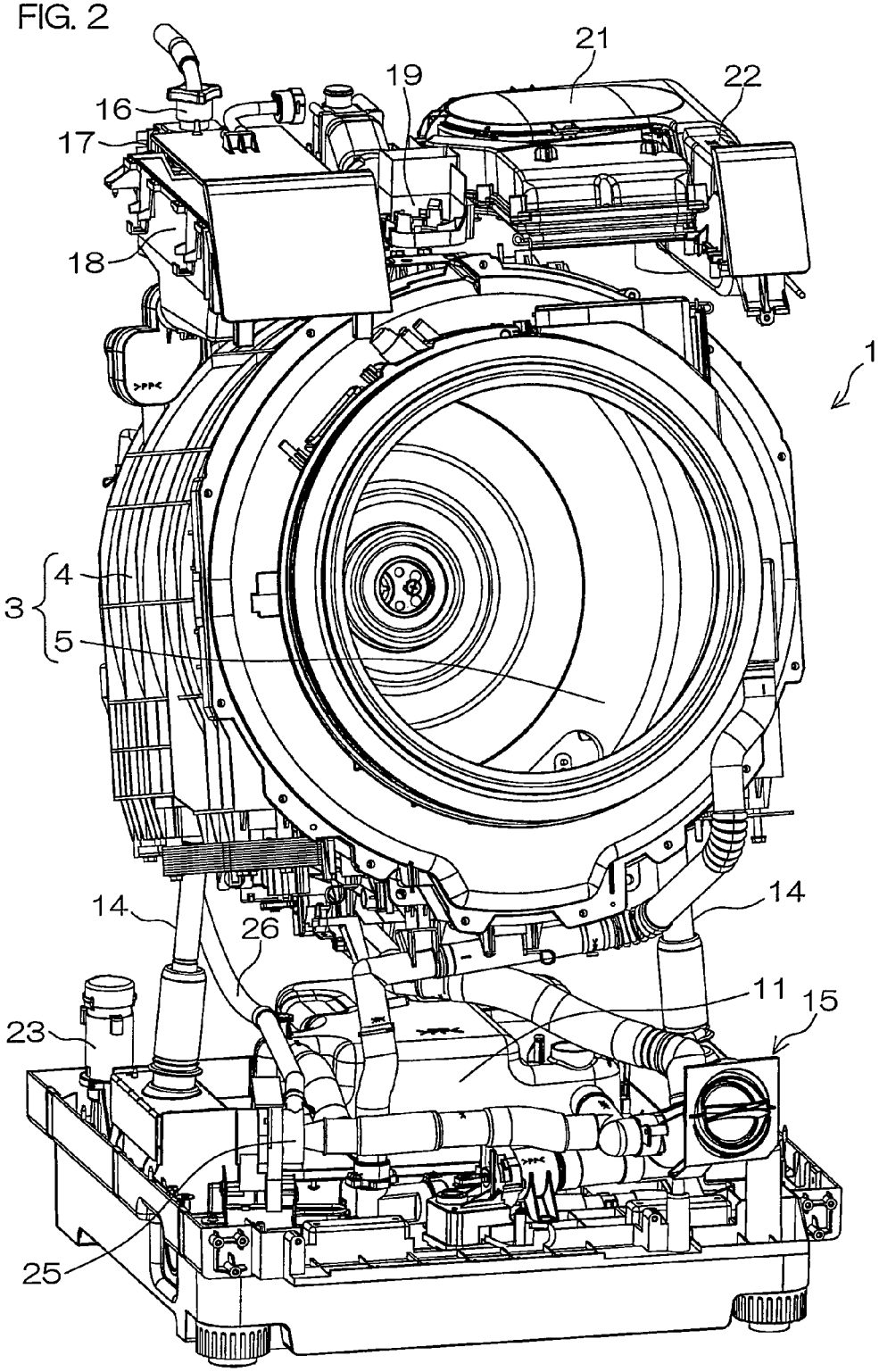
FIG. 2 is a perspective view showing the internal construction of the washing/drying machine 1 with its housing 2 removed as seen obliquely from the front side.
Figure 3:
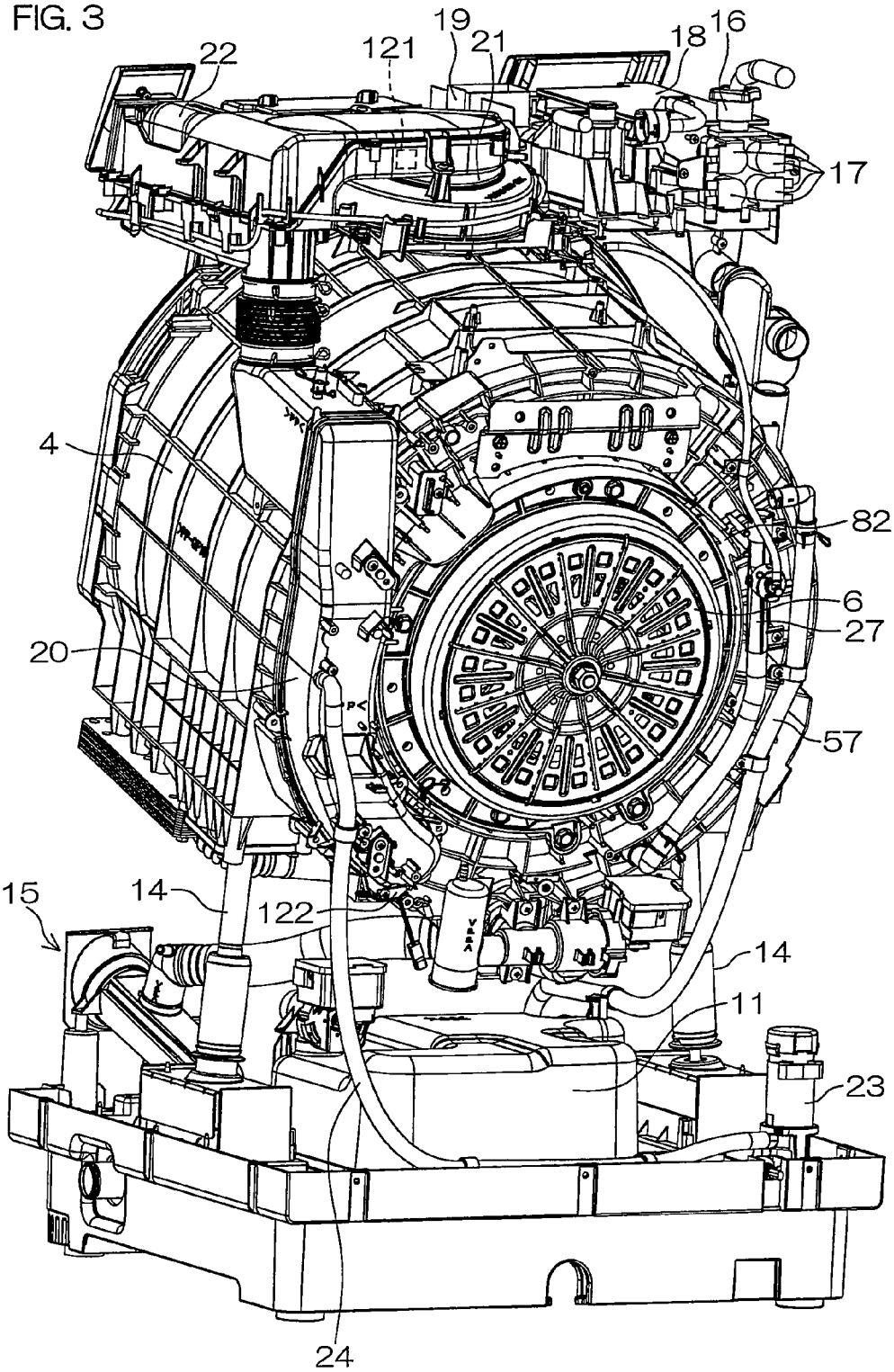
FIG. 3 is a perspective view showing the internal construction of the washing/drying machine 1 with its housing 2 removed as seen obliquely from the rear side.

FIG. 2 is a perspective view showing the internal construction of the washing/drying machine 1 according to the embodiment of the present invention with the housing 2 removed as seen obliquely from the front side. FIG. 3 is a perspective view showing the internal construction of the washing/drying machine 1 with the housing 2 removed as seen obliquely from the rear side.

In FIGS. 2 and 3, the reference numeral 3 denotes the washing tub, which includes the outer tub 4 and the drum 5. The washing tub 3 is supported by resilient support members 14 each including a coil spring and a damper. The tank 11 is disposed below the washing tub 3. A filter unit 15 is disposed on a front right side of the tank 11, and connected to the washing tub 3 and the tank 11 through predetermined hoses and pipes.

A water plug 16, a water supply valve 17 for controlling supply of water flowing from the water plug 16 into a water passage, a water supply port unit 18, an ozone generator 19 which generates ozone for preparation of the cleaning air, the blower 21 for circulating air through a drying air duct 20 in the drying process, and a drying filter unit 22 for trapping foreign matter such as lint contained in the air circulated through the drying air duct 20 by the blower 21 are provided above the washing tub 3.

In the laundry process, tap water supplied from the water plug 16 is retained in the washing tub 3 by controlling the water supply valve 17. At this time, water containing a detergent dissolved therein can be retained in the washing tub 3 by causing water to flow into the washing tub 3 through a detergent container 29 in the water supply port unit 18. In the laundry process, the drum 5 is rotated by the DD motor 6. Further, the water is pumped out of the washing tub 3 through the filter unit 15 by a circulation pump 25, and the pumped water is guided to a rear upper side of the outer tub 4 through a water circulation passage (second water circulation passage 57) and flows down from the upper side and then back into the washing tub 3 from a lower portion of a rear face of the washing tub 3 for circulation. A gas-liquid mixer 27 is provided in the water circulation passage, and the ozone generated by the ozone generator 19 is mixed with the water flowing down from the upper side in the gas-liquid mixer 27. With the ozone mixed with the water, the water is cleaned by the strong oxidation and sterilization power of the ozone. That is, the water in the washing tub 3 is circulated in the laundry process, and cleaned by mixing the ozone with the circulated water for use in the laundry process. As shown in FIG. 3, a projection 82 is provided in the vicinity of the gas-liquid mixer 27 as projecting rearward from a rear face of the outer tub 4 for protecting the gas-liquid mixer 27 attached to the rear face of the outer tub 4 when the outer tub 4 is wobbled to bump against the housing.

In the drying process, air is sucked out of the washing tub 3 from the lower portion of the rear face of the washing tub 3, and guided upward through the drying air duct 20. After foreign matter is filtered away from the air by the drying filter unit 22, the air flows into the washing tub 3 from an upper front side of the washing tub 3 for circulation. High-temperature high-humidity air is heat-exchanged with water to be thereby cooled and dehumidified when being circulated through the drying air duct 20. For this purpose, water is supplied into the drying air duct 20. That is, the washing/drying machine is configured such that water is pumped up from the tank 11 by a drying pump 23, and supplied to a predetermined portion (first position) of the drying air duct 20 via a duct water supply passage 24 such as of a hose. Though not shown, a water passage for supplying the tap water into the drying air duct 20 from the water plug 16 via the water supply valve 17 as required is also provided.

As shown in FIG. 3, a dehumidification water temperature sensor 122 for detecting the temperature of dehumidification water (resulting from the dehumidification of the circulated air through the heat exchange) falling through the drying air duct 20 is provided at a lower end of the drying air duct 20. A drum outlet temperature sensor 121 for detecting the temperature of the circulated air after the heat exchange is provided above the drying air duct 20. The functions of the dehumidification water temperature sensor 122 and the drum outlet temperature sensor 121 will be detailed later.

While the construction and the operation of the washing/drying machine 1 have been thus described, the overall construction, particularly water passages and air passages, of the washing/drying machine 1 will be described in detail with reference to FIG. 4.

Arrangement of Water Passages and Air Passages of Washing/Drying Machine

Figure 4:
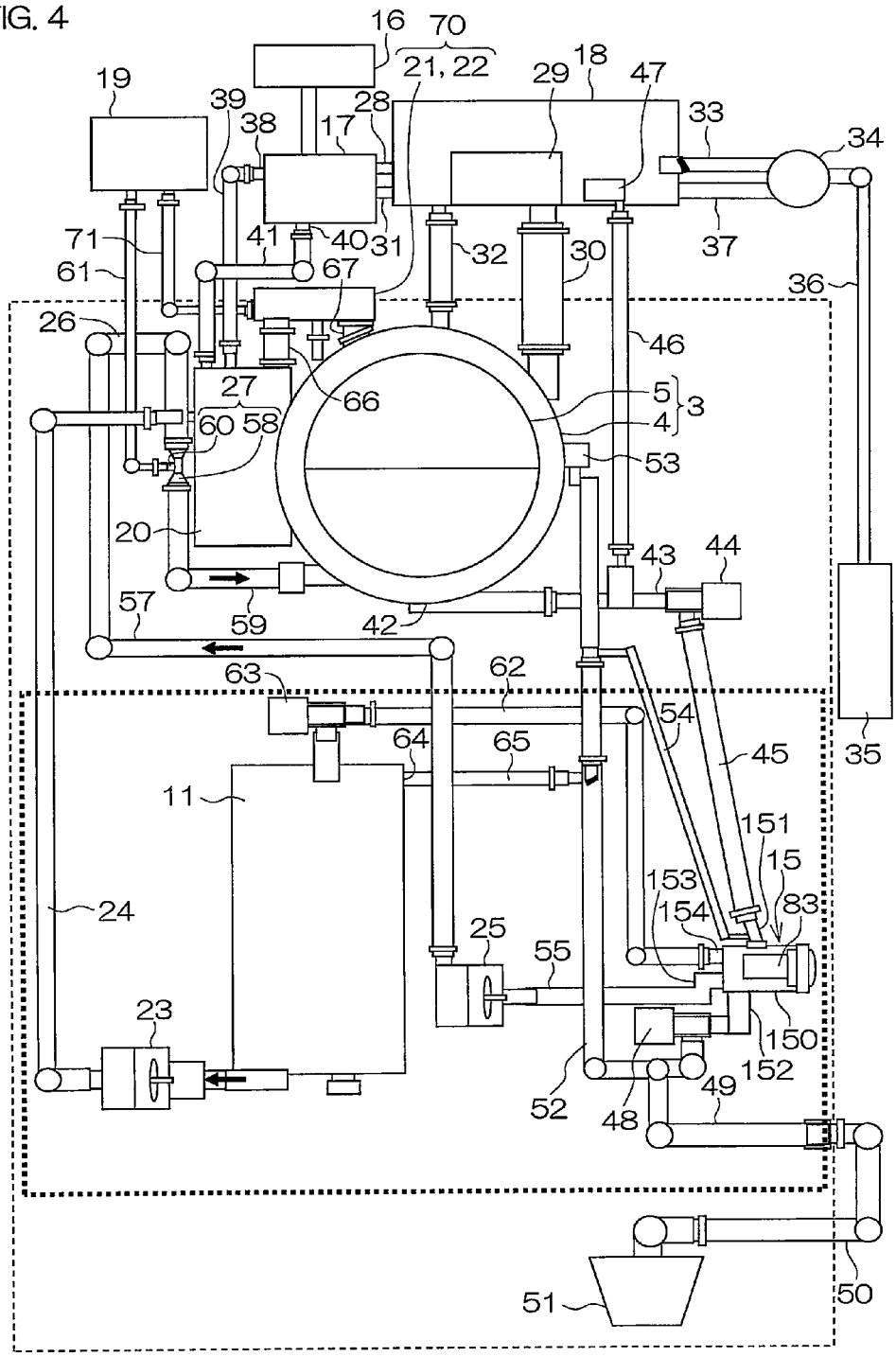
FIG. 4 is a schematic diagram mainly illustrating water passages and air passages of the washing/drying machine 1.

FIG. 4 is a schematic diagram mainly illustrating the water passages and the air passages of the washing/drying machine 1.

The water plug 16 is connected to an inlet of the water supply valve 17. The water supply valve 17 has four outlets through which the water is selectively caused to flow out. A first outlet port 28 of the water supply valve 17 is connected to the water supply port unit 18, so that the water flows through the detergent container 29 provided in the water supply port unit 18. Thus, the water containing the detergent dissolved therein is supplied into the washing tub 3 through a water supply passage 30 to be thereby retained in the washing tub 3. A second outlet port 31 of the water supply valve 17 is also connected to the water supply port unit 18. Water supplied from the second outlet port does not flow through the detergent container 20, but flows into the washing tub 3 through a water supply passage 32. Further, the water flowing into the water supply port unit 18 from the second outlet 31 is partly supplied as priming water into a bathwater pump 34 through a priming water passage 33. When the bathwater pump 34 is driven, bathwater in a bathtub 35 is pumped up into the water supply port unit 18 through a water passage 37, and flows into the washing tub 3 through the water supply passage 30 or the water supply passage 32.

A third outlet port 38 of the water supply valve 17 is connected to a predetermined portion of the drying air duct 20 via a water passage 39. A fourth outlet port 40 of the water supply valve 17 is connected to a predetermined portion of the drying air duct 20 via a water passage 41. The third outlet port 38 has a relatively small diameter, while the fourth outlet port 40 has a relatively great diameter. With the third outlet port 38 being open, therefore, a relatively small amount of water is supplied into the drying air duct 20 through the water passage 39. This water is brought into contact with the circulated high-temperature high-humidity air in the drying air duct 20 for the heat exchange. With the fourth outlet port 40 being open, a relatively great amount of water is supplied into the drying air duct 20 through the water passage 41. This water is used for washing away lint and other foreign matter contained in the air circulated upward in the drying air duct 20 and for washing away lint and other foreign matter adhering to an inner wall of the drying air duct 20.

In the laundry process (a washing step and a rinsing step), water is retained in the washing tub 3. A drain port 42 is provided in a lowermost bottom portion of the washing tub 3 (more specifically, in a lowermost bottom portion of the outer tub 4). An inlet port of a first drain valve 44 is connected to the drain port 42 via a water passage 43, and an outlet port of the first drain valve 44 is connected to an inlet port 151 of the filter unit 15 via a water passage 45. With the first drain valve 44 being closed, water can be retained in the washing tub 3 (outer tub 4). A water level in the washing tub 3 is detected by a water level sensor 47 based on a change in pressure in an air hose 46 branched from the water passage 43 and extending upward.

The filter unit 15 includes a case 150, and a filter body 83 accommodated in the case 150 for trapping foreign matter. The case 150 has a drain port 152, a first outlet port 153 and a second outlet port 154 in addition to the aforementioned inlet port 151. An inlet port of a second drain valve 48 is connected to the drain port 152, and an outlet port of the second drain valve 48 is connected to an external drain hose 50 and a drain trap 51 via a water passage 49. With the first drain valve 44 and the second drain valve 48 being open, the water in the washing tub 3 is drained into the drain trap 51 through the drain port 42, the water passage 43, the first drain valve 44, the water passage 45, the filter unit 15, the drain port 152, the second drain valve 48, the water passage 49 and the external drain hose 50. One end (lower end) of an overflow water passage 52 is connected to the water passage 49. The other end (upper end) of the overflow water passage 52 communicates with an overflow port 53 of the outer tub 4. Therefore, if water is retained in the washing tub 3 in excess to a water level not lower than a predetermined level, water overflows from the overflow port 53, and drained into the drain trap 51 through the overflow water passage 52, the water passage 49 and the external drain hose 50 irrespective of the opening/closing state of the second drain valve 48.

An air pressure adjusting hose 54 is connected to a vertically middle portion of the overflow water passage 52 and the inlet port 151 of the filter unit 15. With the provision of the hose 54, the internal air pressure of the washing tub 3 is equal to an air pressure on the side of the inlet port 151 of the filter unit 15, thereby preventing the back flow of water in the filter unit 15 and other trouble.

One end of a first water circulation passage 55 is connected to the first outlet port 153 of the filter unit 15, and the other end of the first water circulation passage 55 is connected to a suction port of the circulation pump 25. One end of the second water circulation passage 57 is connected to an outlet port of the circulation pump 25. The second water circulation passage 57 extends upward to a position higher than an ordinary water level up to which the water is retained in the washing tub 3, and the other end of the second water circulation passage 57 is connected to a U-turn portion 26 which is U-turned from an upward direction to a downward direction. An upper end of a venturi tube 58 of the gas-liquid mixer 27 is connected to the U-turn portion 26. One end (upper end) of a third water circulation passage 59 is connected to a lower end of the venturi tube 58, and the other end (lower end) of the third water circulation passage 59 is connected to the lower portion of the rear face of the washing tub 3 (outer tub 4).

With the aforementioned arrangement, a predetermined amount of water is retained in the washing tub 3, and the circulation pump 25 is driven with the first drain valve 44 being open and with the second drain valve 48 being closed in the washing step and/or the rinsing step, whereby the water retained in the washing tub 3 is circulated from the drain port 42 through the water passage 43, the first drain valve 44, the water passage 45, the inlet port 151, the case 150, the first outlet port 153, the first water circulation passage 55, the circulation pump 25, the second water circulation passage 57, the U-turn portion 26, the venturi tube 58 and the third water circulation passage 59 into the washing tub 3.

The venturi tube 58 has an air inlet port 60, and the ozone generator 19 is connected to the air inlet port 60 via an air tube 61. If the ozone generator 19 is actuated when water flows through the venturi tube 58, the cleaning air containing the ozone generated by the ozone generator 19 flows through the air tube 61 and then into the venturi tube 58 through the air inlet port 60. A fundamental reason for the flow of the cleaning air into the venturi tube 58 is that there is a pressure difference (negative pressure) caused by the water flowing through the venturi tube 58. When the ozone is mixed with the circulated water, the circulated water is cleaned by the strong oxidation and sterilization power of the ozone. Thus, the laundry process can be performed in the washing tub 3 with the use of the cleaned water.

One end (upper end) of a storage water passage 62 is connected to the second outlet port 154 of the filter unit 15, and the other end (lower end) of the storage water passage 62 is connected to an inlet port of a water storage valve 63. An outlet port of the water storage valve 63 is connected to the tank 11. When the water storage valve 63 is opened with the first drain valve 44 being open, with the second drain valve 48 being closed and with the circulation pump 25 being deactuated after the completion of the rinsing step, for example, the water used for the rinsing operation and retained in the washing tub 3 flows into the tank 11 from the drain port 42 through the water passage 43, the first drain valve 44, the water passage 45, the inlet port 151, the case 150, the second outlet port 154, the storage water passage 62 and the water storage valve 63 by gravity (natural falling). Thus, the water used for the rinsing operation is stored as recycling water in the tank 11.

An overflow port 64 is provided at an upper portion of the tank 11. One end of a water passage 65 is connected to the overflow port 64, and the other end of the water passage 65 is connected to a middle portion of the overflow water passage 52. If water is retained in the tank 11 to a water level not lower than a predetermined level, the water overflows to the drain trap 51 from the overflow port 64 through the water passage 65, the overflow water passage 52, the water passage 49 and the external drain hose 50.

In the washing/drying machine 1, the used water is retained in the tank 11, and reused as the recycling water in the drying process.

The washing/drying machine 1 includes the drying air duct 20 for a drying function. The drying air duct 20 is disposed outside the washing tub 3 (outer tub 4). The drying air duct 20 is an air duct through which air sucked out of the washing tub 3 through the lower portion of the rear face of the outer tub 4 is circulated to flow into the washing tub 3 from a front upper portion of the outer tub 4. The drying air duct 20 includes a connection pipe 66, a filter blower unit 70 (including the blower 21 and the drying filter unit 22), and a connection pipe 67. As described with reference to FIG. 1, the drying heater A124 and the drying heater B125 (not shown) are provided in the air duct extending from the filter blower unit 70 to the connection pipe 67 for heating the circulated air. For example, semiconductor heaters may be used as the drying heaters.

The air sucked out of the washing tub 3 is dehumidified in the drying air duct 20. Further, the foreign matter such as lint contained in the air circulated through the drying air duct 20 and the foreign matter adhering to the inner wall of the drying air duct 20 are washed away. For this purpose, the recycling water retained in the tank 11 is circulated to flow through the drying air duct 20.

A suction port of the drying pump 23 is connected to the tank 11. One end of the duct water supply passage 24 is connected to an outlet port of the drying pump 23, and the other end of the duct water supply passage 24 is connected to the first position of the drying air duct 20. In the drying process, water flows through the duct water supply passage 24 to be supplied into the drying air duct 20 from the first position of the drying air duct 20 upon actuation of the drying pump 23. As described above, the supplied water is heat-exchanged with the air circulated upward from the lower side in the drying air duct 20, and washes away the lint and other foreign matter contained in the air and the foreign matter adhering to the inner wall of the drying air duct 20. Water flowing down together with the lint and other foreign matter in the drying air duct 20 further flows into the filter unit 15 from the lower portion of the outer tub 4 through the drain port 42, the water passage 43, the first drain valve 44 and the water passage 45. Then, the lint and other foreign matter are trapped and filtered away in the filter unit 15, and water free from the foreign matter flows back into the tank 11 from the second outlet port 154 through the storage water passage 62 and the water storage valve 63.

The washing/drying machine may be configured such that the water flowing down in the drying air duct 20 is drained, for example, from a lower end (second position) of the drying air duct 20 and flows back into the tank 11 rather than into the outer tub 4.

In the drying process, a great amount of water is required for the heat exchange in the drying air duct 20 and for the removal of the lint and other foreign matter adhering to the inner wall of the drying air duct 20. The washing/drying machine 1 is configured such that the used water stored in the tank 11 is recycled to be used for the heat exchange and the removal of the foreign matter. Thus, drastic water saving can be achieved. Since the water is circulated from the tank 11, the volume of the tank 11 is reduced. Even with the provision of the tank 11, the outer size of the washing/drying machine is not increased.

The ozone generator 19 is connected to the filter blower unit 70 via an air tube 71. In the drying process, the cleaning air containing the ozone generated by the ozone generator 19 is sucked into the filter blower unit 70 upon actuation of the ozone generator 19, and mixed with the air to be circulated into the washing tub 3. As a result, the garment to be dried can be deodorized and sterilized.

Configuration of Water Circulation Passage

Figure 5:
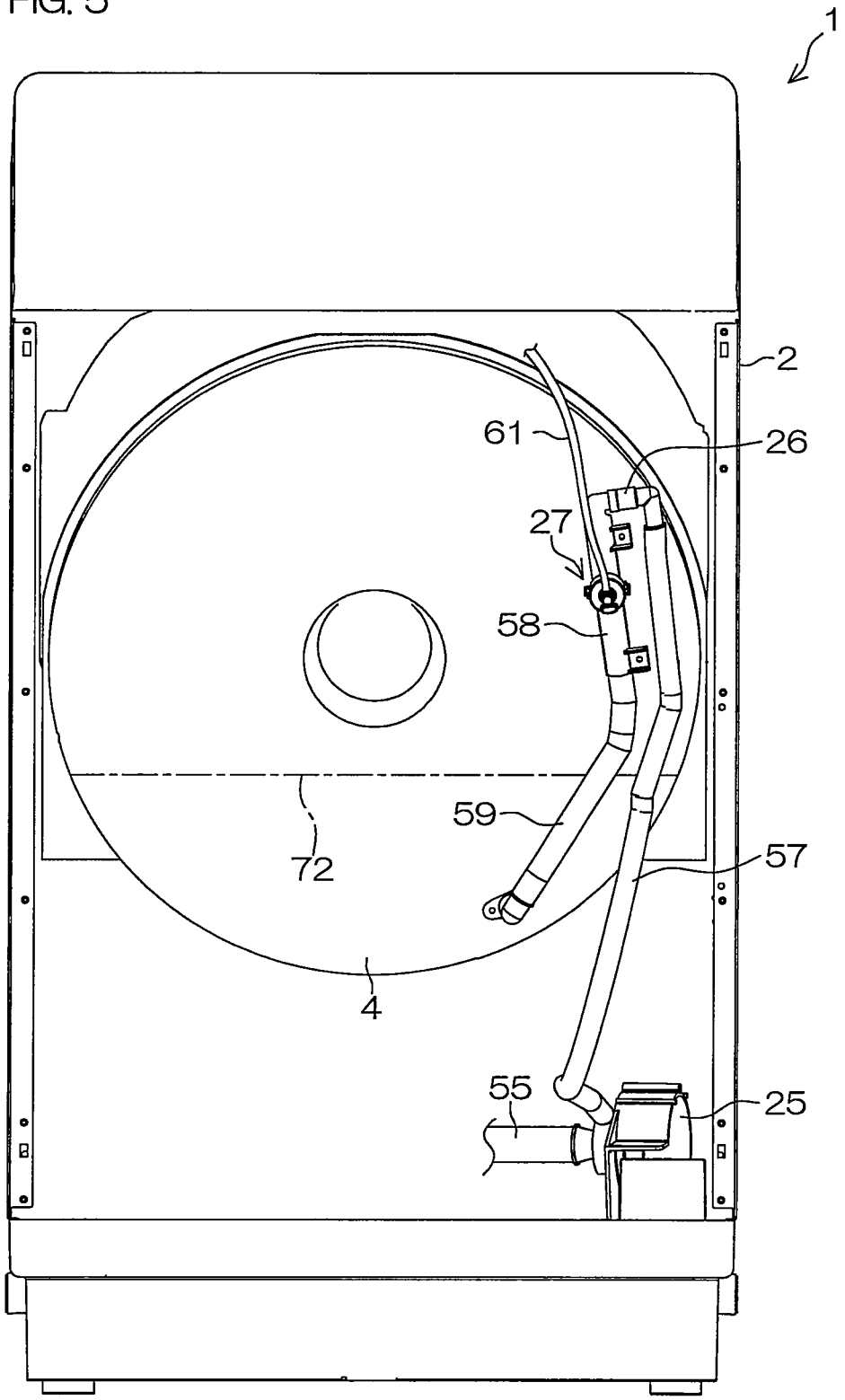
FIG. 5 is a rear view of the washing/drying machine 1 for explaining a water circulation passage structure including a first water circulation passage 55, a circulation pump 25, a second water circulation passage 57, a U-turn portion 26, a gas-liquid mixer 27 (venturi tube 58) and a third water circulation passage 59.

FIG. 5 is a rear view of the washing/drying machine 1 for explaining a water circulation passage structure including the first water circulation passage 55, the circulation pump 25, the second water circulation passage 57, the U-turn portion 26, the gas-liquid mixer 27 (venturi tube 58) and the third water circulation passage 59. In FIG. 5, only components required for the explanation are shown.

Water resulting from the filtering by the filter unit 15 (see FIG. 4) is sucked into the circulation pump 25 through the first water circulation passage 55 and ejected into the second water circulation passage 57 by driving the circulation pump 25. The second water circulation passage 57 extends upward from the lower side to guide the water to the position higher than the ordinary water level (indicated by a one-dot-and-dash line 72) up to which the water is retained in the outer tub 4. The water flows into the gas-liquid mixer 27 with its flow direction reversed from the upward direction to the downward direction by the U-turn portion 26. Thus, the water flows down from the upper side in the gas-liquid mixer 27. The gas-liquid mixer 27 is also disposed at a position higher than the ordinary water level 72 up to which the water is retained in the outer tub 4. Therefore, the flow direction of the water pumped into the second water circulation passage 57 by the circulation pump 25 is reversed at the position higher than the water level 72. Thus, the water swiftly flows down through the gas-liquid mixer 27, because the water falls down from the position higher than the water level 72 through the gas-liquid mixer 27. Then, the water flows through the third water circulation passage 59, and then into the outer tub 4 from the lower portion of the rear face of the outer tub 4.

The water circulation passage structure thus includes the second water circulation passage 57 for guiding the water to the position higher than the water level 72 in the outer tub 4, and the U-turn portion 26 for reversing the flow direction of the water guided upward. Therefore, the gas-liquid mixer 27 can be located at the position that is higher than the water level 72 in the outer tub 4. In addition, the gas-liquid mixer 27 can be disposed as extending vertically. Thus, a water pressure occurring due to the water level 72 does not hinder the flow of the water in the gas-liquid mixer 27, but the water swiftly flows down from the upper side due to the pumping force of the circulation pump 25 as well as the gravity. As a result, a negative pressure occurs in the flow passage, so that the ozone-containing cleaning air can be efficiently mixed with the water in the gas-liquid mixer 27.

Further, the water falling down through the gas-liquid mixer 27 is guided downward through the third water circulation passage 59, and circulated into the outer tub 4 from the lower portion of the rear face of the outer tub 4. The circulated water, which contains minute bubbles of the ozone-containing cleaning air, flows back into the washing tub 3 from the lower portion of the outer tub 4. Thus, the minute bubbles of the cleaning air contained in the water move upward from the lower side in the washing tub 3, whereby the garment is efficiently cleaned, sterilized and deodorized in the washing tub 3.

The third water circulation passage 59 is not necessarily required to extend to the lower portion of the outer tub 4, but may be configured to cause the water to flow into the outer tub 4 from a vertically middle portion of the rear face of the outer tub 4 for the circulation.

A reference numeral 61 denotes the air tube. The ozone-containing cleaning air is supplied into the gas-liquid mixer 27 through the air tube 61.

Structures of U-Turn Portion and Gas-Liquid Mixer

Figure 6:
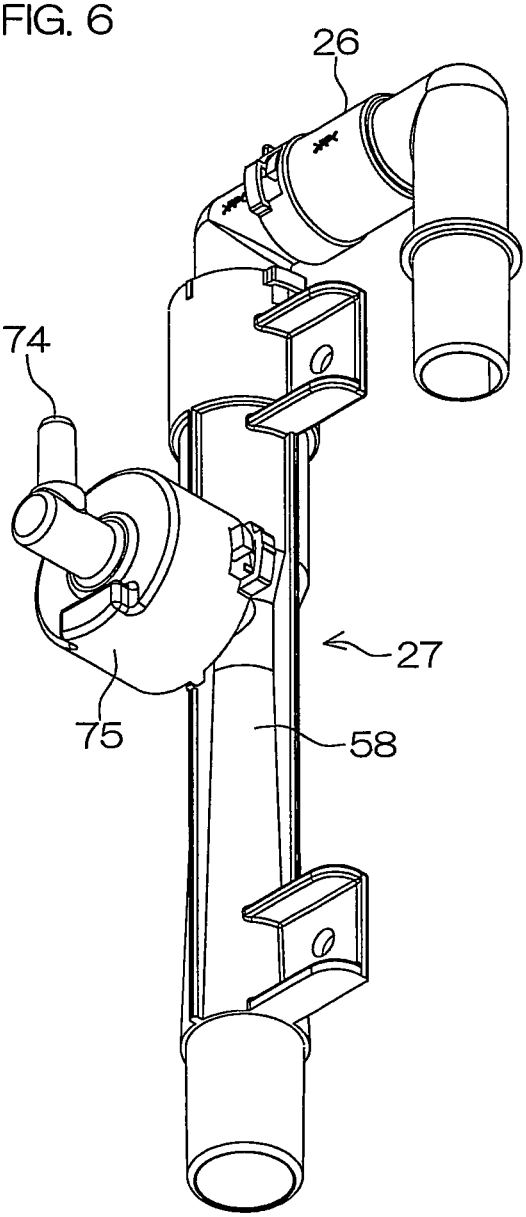
FIG. 6 is a perspective view showing specific structures of the U-turn portion 26 and the gas-liquid mixer 27.

FIG. 6 is a perspective view showing specific structures of the U-turn portion 26 and the gas-liquid mixer 27. In this embodiment, the U-turn portion 26 and the gas-liquid mixer 27 are provided by connecting resin pipes to each other. The gas-liquid mixer 27 includes the venturi tube 58, an air intake port 74 and a buffer chamber 75.

Figure 7:
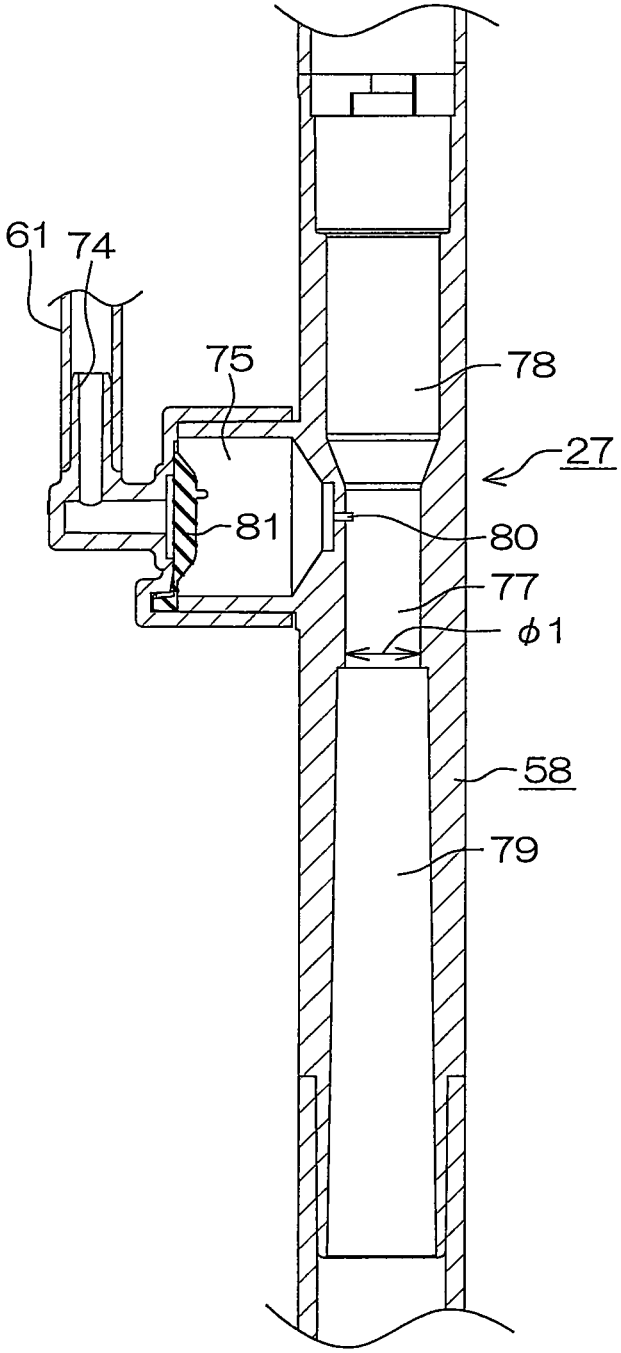
FIG. 7 is a vertical sectional view showing the internal structure of the gas-liquid mixer 27.

FIG. 7 is a vertical sectional view showing the internal structure of the gas-liquid mixer 27. As described above, the gas-liquid mixer 27 includes the venturi tube 58. The venturi tube 58 extends vertically, and includes three types of flow passages having different flow passage diameters and connected to one another, i.e., an upstream flow passage 78 provided on an upper side and having a greater flow passage diameter, a restrictive flow passage 77 provided on a lower side of the upstream flow passage 78 and having a smaller flow passage diameter, and a downstream flow passage 79 provided on a lower side of the restrictive flow passage 77 and having a progressively increased flow passage diameter. When the water flows through the upstream flow passage 78, the restrictive flow passage 77 and the downstream flow passage 79, the speed (flow rate) of the water flowing through the restrictive flow passage 77 is increased. Further, an inner wall of the restrictive flow passage 77 is formed with a small hole 80 for air intake. The small hole 80 communicates with the buffer chamber 75 connected to an outer surface of the venturi tube 58. Air is supplied into the buffer chamber 75 from the air intake port 74. A check valve 81 such as of a rubber is disposed at an inlet of the buffer chamber 75. The check valve 81 permits the flow of the air into the buffer chamber 75 from the air intake port 74, but prevents the flow of gas and liquid from the inside of the buffer chamber 75 to the air intake port 74.

The water falling down from the U-turn portion 26 swiftly flows into the upstream flow passage 78, and its flow rate is increased in the restrictive flow passage 77. Therefore, a negative pressure occurs to permit the air intake from the buffer chamber 75 through the air intake hole 80. The negative pressure causes the ozone-containing cleaning air to flow into the restrictive flow passage 77 from the buffer chamber 75 through the air intake hole 80, whereby the cleaning air is mixed in the form of minute air bubbles with the flowing water.

There is a possibility that, when the water flow in the restrictive flow passage 77 is stopped, the water would flow into the buffer chamber 75 through the air intake hole 80 and further flow back to the ozone generator 19 (see FIG. 4) from the air intake port 74. In this embodiment, however, the check valve 81 is provided in the buffer chamber 75. As a result, the ozone generator 19 is free from any inconvenience, which may otherwise occur due to water flowing back through the air tube 61. Further, there is a possibility that, in the drying process, steam would flow into the third water circulation passage 59 from the washing tub 3, then flow through the venturi tube 58 and then into the buffer chamber 75 from the air intake hole 80, and further flow back into the ozone generator 19 from the air intake port 74. However, the back flow of the steam in the drying process is also prevented by the check valve 81.

In this embodiment, the inner diameter of the restrictive flow passage 77 is Ø=8 mm. As will be described later, the inner diameter Ø is greater than a filter mesh diameter of the filter unit 15. As a result, there is no fear that the restrictive flow passage 77 would be clogged with foreign matter such as lint contained in the flowing water.

Structure of Filter Unit

Next, the structure of the filter unit 15 will be described.

As described with reference to FIG. 2, the filter unit 15 is provided in the front lower right portion of the washing/drying machine 1. The filter unit 15 includes the case 150, the inlet port 151, the drain port 152, the first outlet port 153 and the second outlet port 154 as described with reference to FIG. 4.

Figure 8:
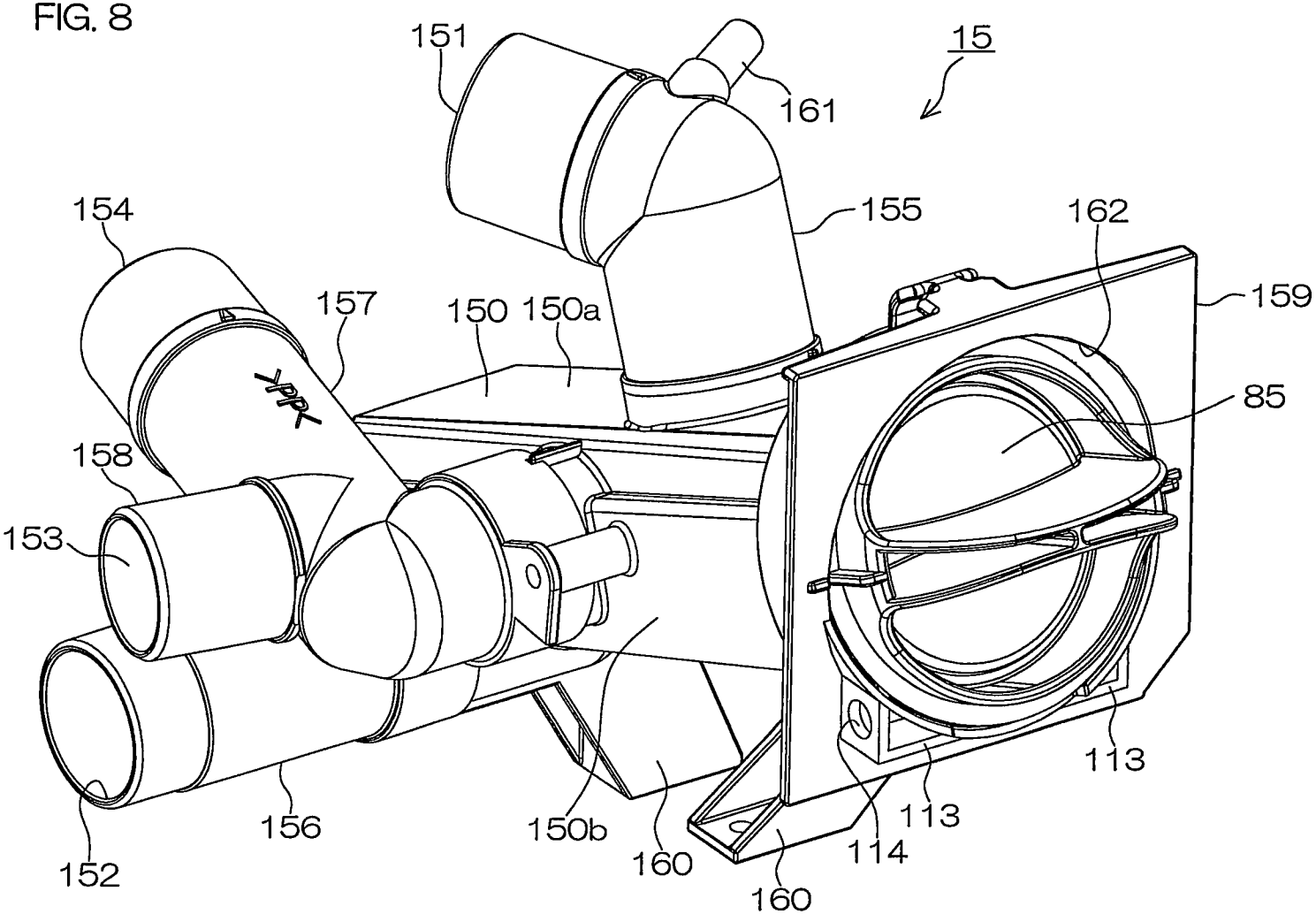
FIG. 8 is a perspective view of a filter unit 15.

FIG. 8 is a perspective view illustrating the filter unit 15 as seen obliquely from the front side of the washing/drying machine 1.

Referring to FIG. 8, the filter unit 15 includes the case 150, an inlet pipe 155, a drain pipe 156, outlet pipes 157, 158, a front fixture plate 159 and fixture legs 160. These components are composed of a resin (e.g., polypropylene). The front fixture plate 159 and the fixture legs 160 are formed integrally with the case 150, and the drain pipe 156, the inlet pipe 155 and the outlet pipes 157, 158 which are separately formed are liquid-tightly connected to the case 150.

With the front fixture plate 159 and the fixture legs 160 attached to the housing 2 of the washing/drying machine 1, the case 150 has an elongated shape extending obliquely downward rearward from the front side. The case 150 has a hole (not shown) provided in an upper surface 150*a* thereof, and the inlet pipe 155 is attached to the upper surface 150*a* for communication with the hole. As described with reference to FIG. 4, the water passage 45 is connected to an upper open end of the inlet pipe 155 serving as the inlet port 151. The hose 54 described with reference to FIG. 4 is connected to a tubular projection 161 projecting from a middle portion of the inlet pipe 155.

The case 150 has right and left side surfaces and a bottom surface which collectively define a seamless case lateral/bottom surface 150*b* arcuately bulged downward.

The drain pipe 156 projects laterally from the case lateral/bottom surface 150*b* in a direction crossing a longitudinal axis of the case 150, more specifically perpendicularly to the longitudinal axis of the case 150, and its distal end serves as the drain port 152. The drain pipe 156 projects from an innermost longitudinal end portion of the case 150 (from a lower end portion of the obliquely extending case 150).

The outlet pipe 157 has a longitudinally middle portion which is generally perpendicularly bent, and is fixed to a portion of the case 150 intermediate between a fixing position of the inlet pipe 155 and a fixing position of the drain pipe 156 as seen longitudinally of the case 150. The outlet pipe 157 is fixed to the case 150 as projecting laterally from the lateral/bottom surface 150*b* of the case 150, and a distal end of the portion bent at about 90 degrees is defined as the second outlet port 154. The outlet pipe 158 is connected to the outlet pipe 157 as being branched from the outlet pipe 157, and a distal end of the pipe 158 is defined as the first outlet port 153. As described with reference to FIG. 4, the suction port of the second drain valve 48, the first water circulation passage 55 and the storage water passage 62 are connected to the drain port 152, the first outlet port 153 and the second outlet port 154, respectively.

The front fixture plate 159 has a filter insertion port 162. The filter insertion port 162 communicates with the inside space of the case 150. The filter body 83 (see FIG. 9) is inserted into the case 150 through the filter insertion port 162, and an operable lid 85 is turned to a state as shown in FIG. 8. In this state, the filter unit 15 can function normally.

Figure 21:
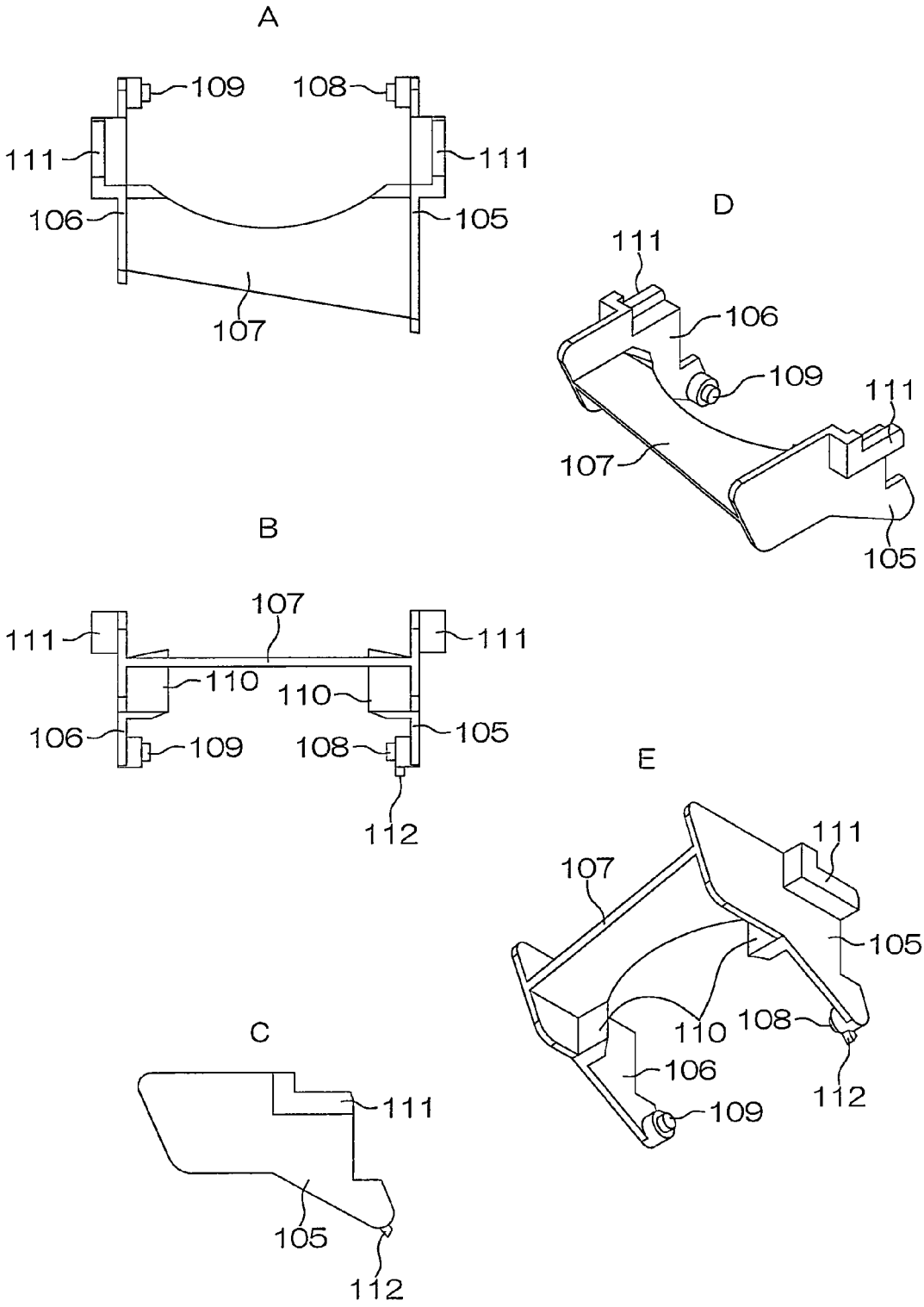
FIGS. 21A, 21B and 21C are a plan view, a front view and a right side view showing a specific structure of a movable member 103.
FIGS. 21D and 21E are perspective views of the movable member 103 as seen obliquely from an upper side and a lower side, respectively.

Ribs 113 are provided on the front fixture plate 159 on lower opposite sides of the filter insertion port 162 as projecting forward. The ribs 113 respectively have engagement holes 114 in which a movable member (see FIG. 21) to be described later is pivotally fitted.

Figure 9:
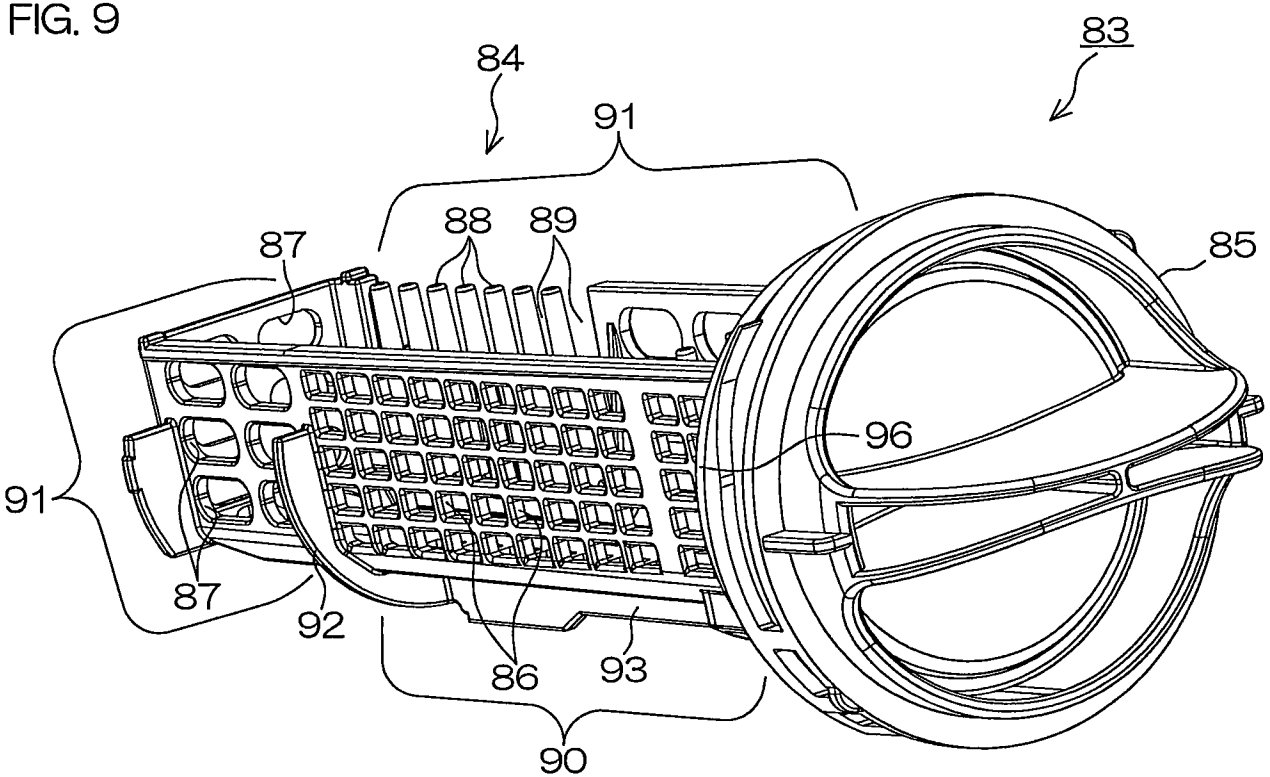
FIG. 9 is a perspective view showing the structure of a filter body 83.

FIG. 9 is a perspective view showing the structure of the filter body 83. The filter body 83 includes a basket 84 serving as a filtering member, and the operable lid 85. The basket 84 is composed of a resin, and has an open top, and a multiplicity of filtering holes and filtering slits formed in a predetermined arrangement in side walls and a bottom wall thereof.

Figure 10:
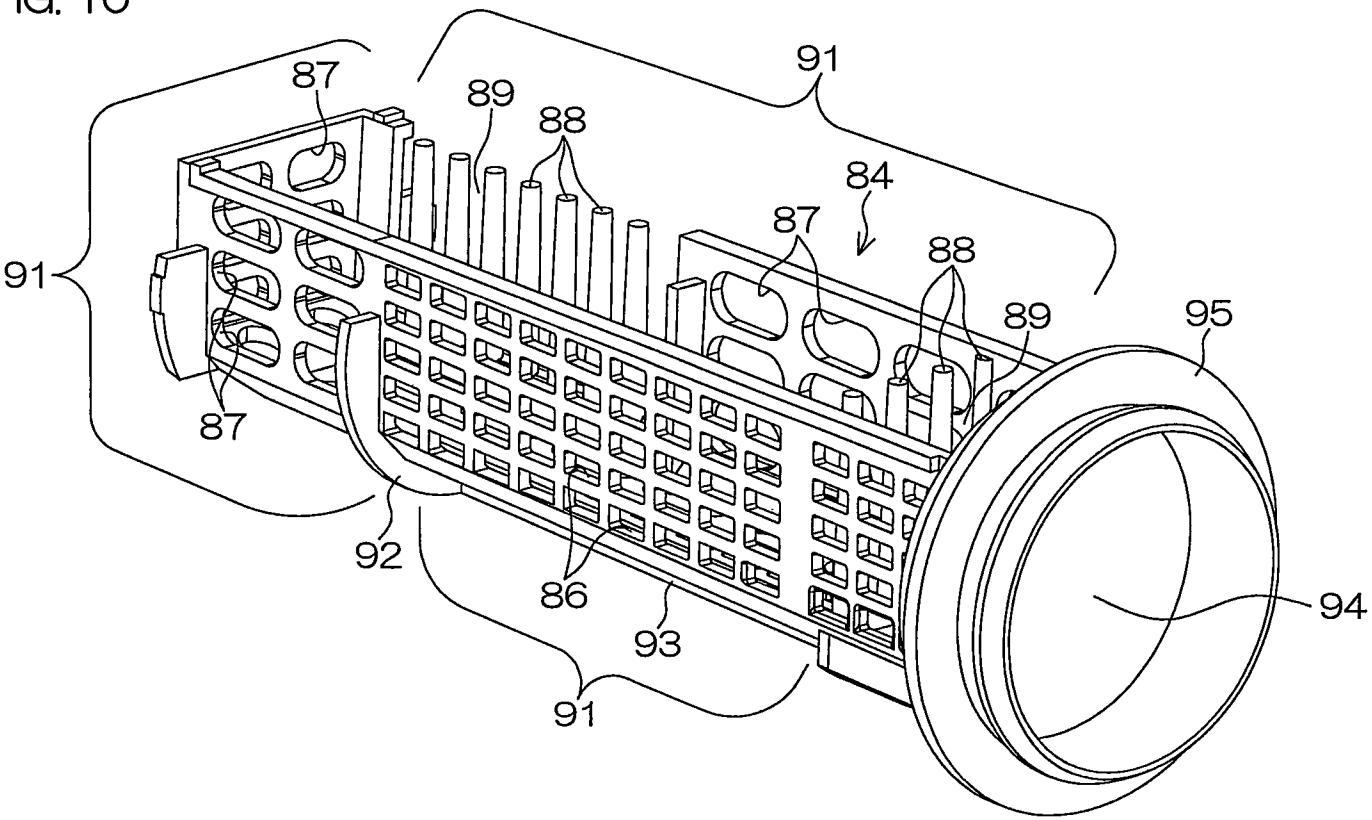
FIG. 10 is a perspective view showing the structure of a basket 84 with an operable lid 85 removed from the filter body 83.

FIG. 10 is a perspective view showing the structure of the basket 84 with the operable lid 85 removed from the filter body 83.

Referring to FIGS. 9 and 10, the filtering holes of the basket 84 include smaller filtering holes 86 each having a size (maximum diameter) not greater than a predetermined level, larger filtering holes 87 each having a greater size, and slits 89 defined between comb-like rods 88. The smaller filtering holes 86 are provided in front portions of the left side wall and the bottom wall of the basket 84. The wall portions formed with the smaller filtering holes 86 are collectively defined as a recycling water filtering wall portion 90. On the other hand, a rear portion of the left side wall, a rear wall, a portion of the bottom wall and a portion of the right side wall of the basket 84 formed with the larger filtering holes 87, and a wall portion of the basket 84 having the slits 89 defined between the rods 88 are collectively defined as a drain water filtering wall portion 91. Partitioning ribs 92, 93 are provided along a boundary between the recycling water filtering wall portion 90 and the drain water filtering wall portion 91 as projecting from an outer surface of the basket 84.

A front face of the basket 84 is closed with a sealing wall 94, and an annular flange 95 projects from the periphery of the sealing wall 94 (see FIG. 10).

As shown in FIG. 9, the operable lid 85 is rotatably fitted on the flange 95 shown in FIG. 10. The operable lid 85 and the basket 84 are rotatable relative to each other. A seal ring 96 such as of a rubber is provided on a rear peripheral surface of the operable lid 85. The basket 84 of the filter body 83 is inserted into the case 150 from the filter insertion port 162 shown in FIG. 8. After the insertion, the operable lid 85 is turned, whereby a gap between the filter insertion port 162 and the operable lid 85 is liquid-tightly sealed by the seal ring 96. Thus, the filter body 83 is completely fixed to the case 150. The inner wall of the case 150 has a specific configuration such that the basket 84 can be accommodated in a predetermined orientation in the case 150.

Figure 11:
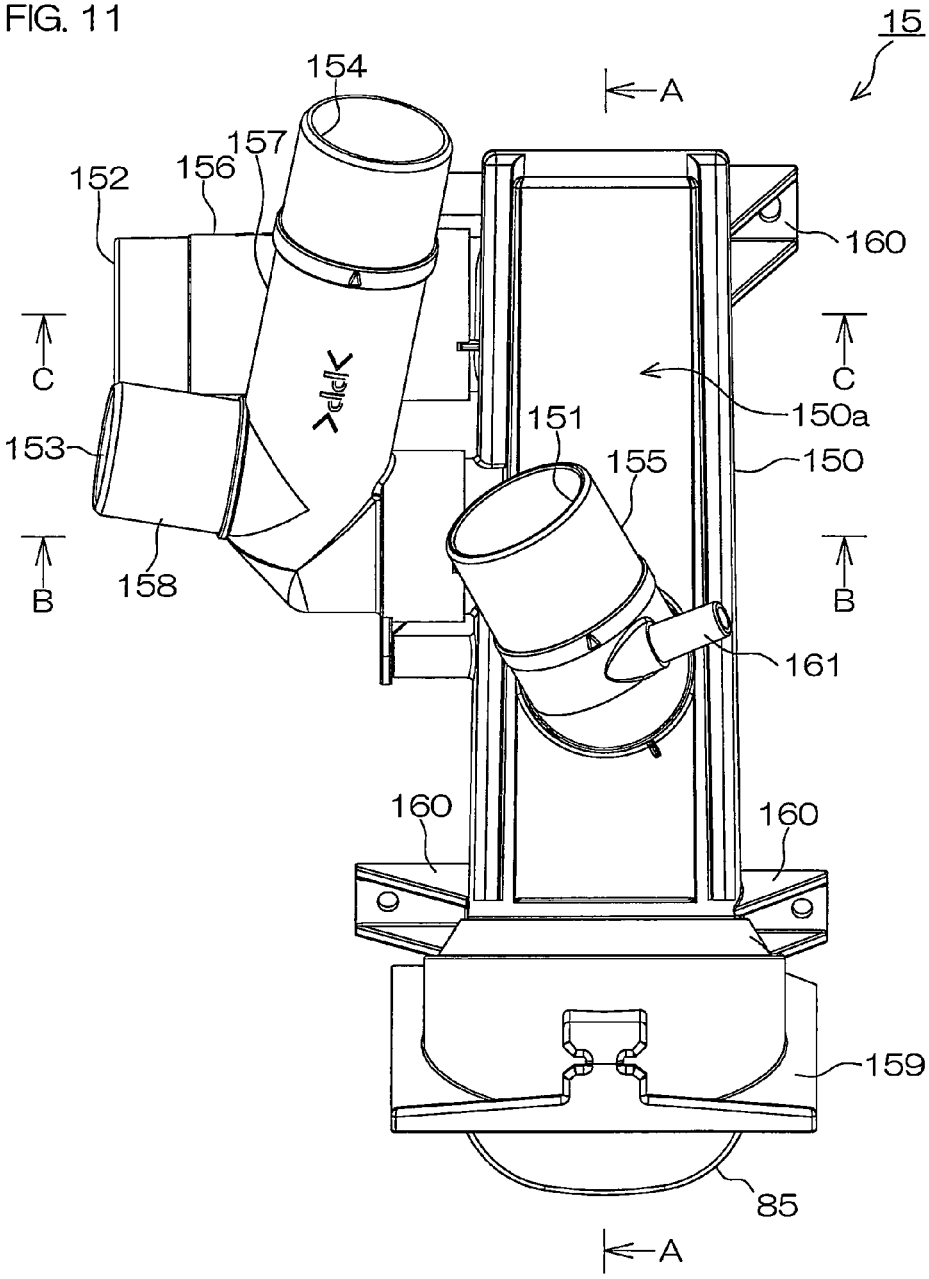
FIG. 11 is a plan view of the filter unit 15.
Figure 12:
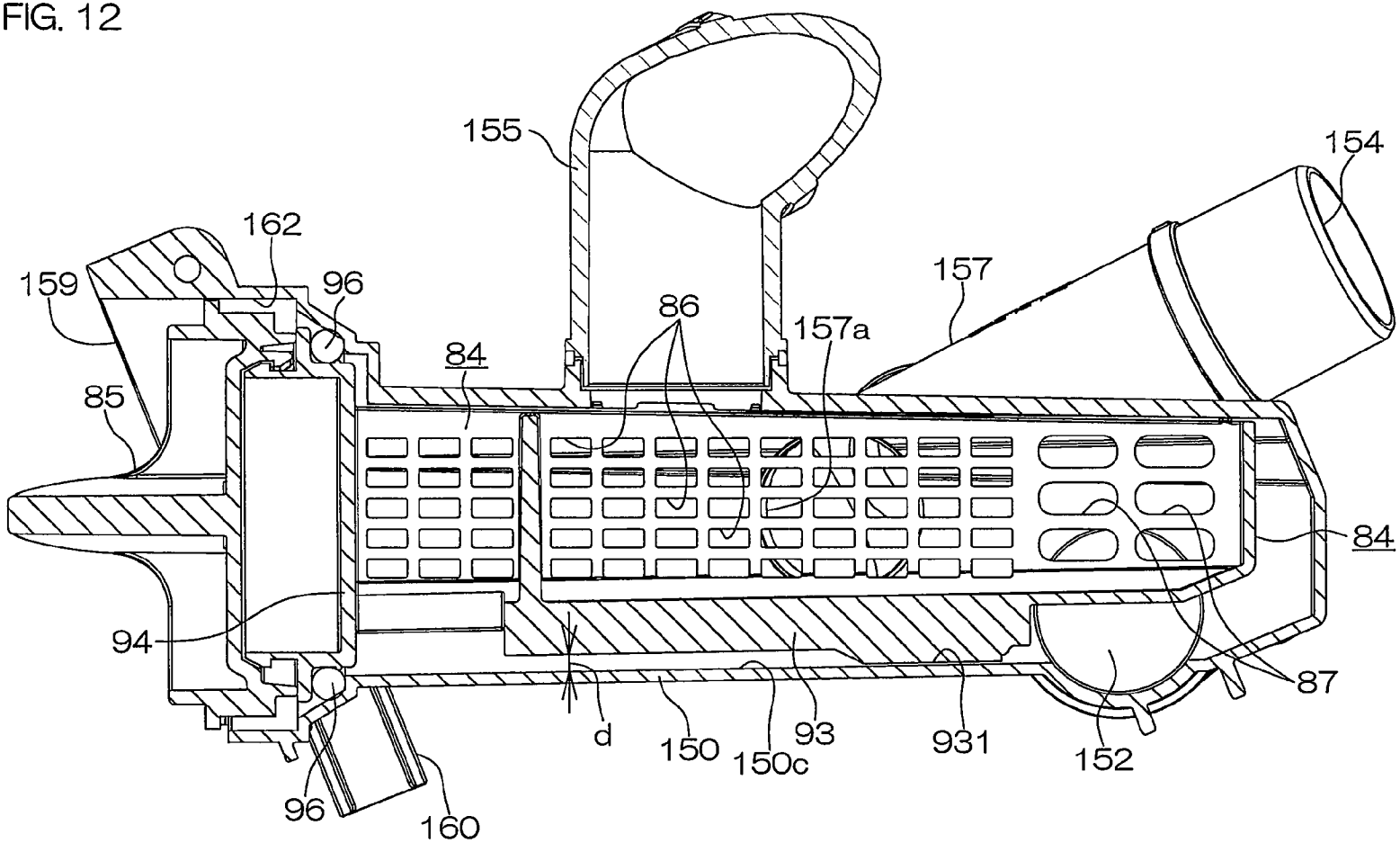
FIG. 12 is a longitudinal sectional view of the filter unit 15 taken along a line A-A in FIG. 11.
Figure 13:
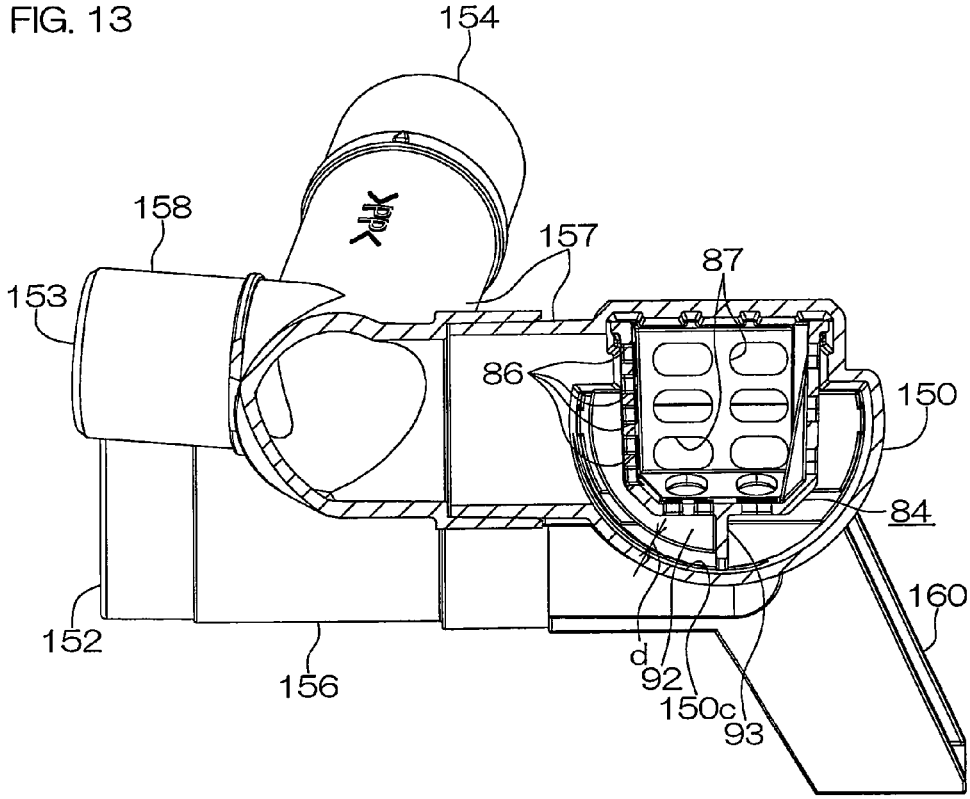
FIG. 13 is a transverse sectional view of the filter unit 15 taken along a line B-B in FIG. 11.
Figure 14:
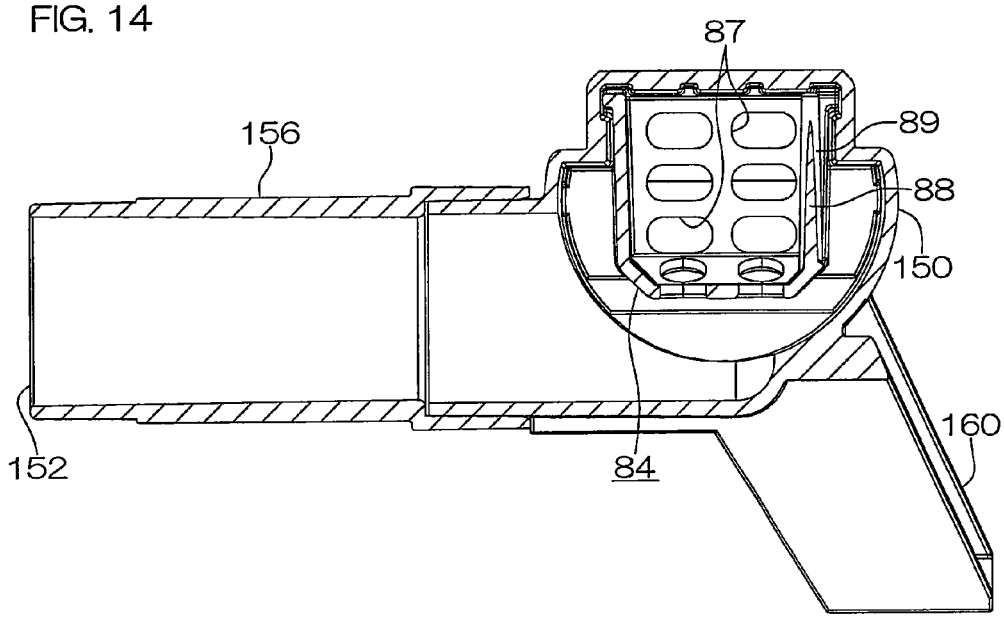
FIG. 14 is a transverse sectional view of the filter unit 15 taken along a line C-C in FIG. 11.

FIG. 11 is a plan view of the filter unit 15. FIG. 12 is a longitudinal sectional view of the filter unit 15 taken along a line A-A in FIG. 11. FIG. 13 is a transverse sectional view of the filter unit 15 taken along a line B-B in FIG. 11. FIG. 14 is a transverse sectional view of the filter unit 15 taken along a line C-C in FIG. 11.

As shown in FIG. 12, the rib 93 is provided on the basket 84 as projecting downward from the bottom wall and extending anteroposteriorly (longitudinally of the case 150). The rib 93 is configured so that the basket 84 set in the case 150 is spaced a distance d (mm) (which is not greater than the size (maximum diameter) of the smaller filtering holes) from an inner bottom surface 150*c* of the case 150. A part 931 of the rib 93 is brought into contact with the inner bottom surface 150*c* of the case 150, thereby functioning to position the basket 84 in the case 150. Where larger-size foreign matter is present in water flowing outside the basket 84 through the larger filtering holes 87 and the slits 89 (see FIG. 10) formed in the drain water filtering wall portion 91 present on the front side in FIG. 12 and further flowing into an inlet port 157*a* of the outlet pipe 157 through a space defined between a lower surface of the basket 84 and the inner bottom surface 150*c* of the case 150, the rib 93 prevents the foreign matter from flowing into the inlet port 157*a* of the outlet pipe 157.

Referring next to FIG. 13, the rib 92 projecting from the outer surface of the basket 84 spaces the basket 84 a predetermined distance d (mm) (which is not greater than the size (maximum diameter) of the smaller filtering holes) from the inner side surface and the inner bottom surface 150*c* of the case with the filter body 83 being set in the case 150. Therefore, where larger-size foreign matter is present in water flowing outside the basket 84 through the larger filtering holes 87 formed, for example, in the rear portion of the side wall of the basket 84 and further flowing forward into the outlet pipe 157 through a space defined between the basket 84 and the inner side surface or the inner bottom surface 150*c* of the case 150, the rib 92 prevents the foreign matter from flowing into the outlet pipe 157.

Thus, the ribs 92, 93 are provided as surrounding the recycling water filtering wall portion 90 formed with the smaller filtering holes 86. The ribs 92, 93 are opposed to the inner surfaces of the case 150 so as not to form a gap larger than the size of the smaller filtering holes 86 around the recycling water filtering wall portion 90. Thus, the water flowing into the basket 84 is filtered through the recycling water filtering wall portion 90 formed with the smaller filtering holes 86, and the water flowing through the recycling water filtering wall portion 90 and the water flowing through the gap defined between the ribs 92, 93 and the inner surfaces of the case 150 are permitted to flow into the outlet pipe 157. Thus, the water flowing into the outlet pipe 157 does not contain foreign matter greater in size than the smaller filtering holes 86.

The size (maximum diameter) of the smaller filtering holes 86 is set smaller than the inner diameter Ø of the restrictive flow passage 77 of the venturi tube 58 of the gas-liquid mixer 27, so that foreign matter having a size greater than the inner diameter Ø of the restrictive flow passage 77 is not present in the water flowing through the venturi tube 58. This prevents slow-down or stop of the water flow in the venturi tube 58, which may otherwise occur when the restrictive flow passage 77 having a reduced flow diameter is clogged with the foreign matter.

As shown in FIG. 14, water flows out of the drain pipe 156 after being filtered through the larger filtering holes 87 and the slits 89 of the basket 84, so that greater size foreign matter does not flow out through the drain pipe 156. This eliminates the possibility of clogging of the drain port.

As apparent from FIGS. 8 to 14, the case 150 of the filter unit 15 has an elongated shape extending obliquely downward rearward from the front, and the basket 84 of the filter body 83 is accommodated in the case 150. The outlet pipe 157 is located forward of the drain pipe 156, i.e., is attached to the case 150 at a higher position than the drain pipe 156. As shown in FIGS. 9 and 10, the recycling water filtering wall portion 90 is located on a forward (upper) side, while the drain water filtering wall portion 91 is located on a rearward (lower) side. Therefore, if foreign matter is contained in the water flowing into the basket 84, larger foreign matter falls on the rearward (lower) side in the water, and water containing a smaller amount of foreign matter is filtered through the recycling water filtering wall portion 90. That is, this arrangement improves the efficiency of filtering the washing water and the rinsing water in the filter unit 15.

Arrangement for Indicating Improper Operation of Operable Lid

Next, an arrangement for letting a user know that the operable lid 85 of the filter unit 15 is improperly operated and the filter body 83 is incorrectly mounted in the case 150 will be described.

Figure 15:
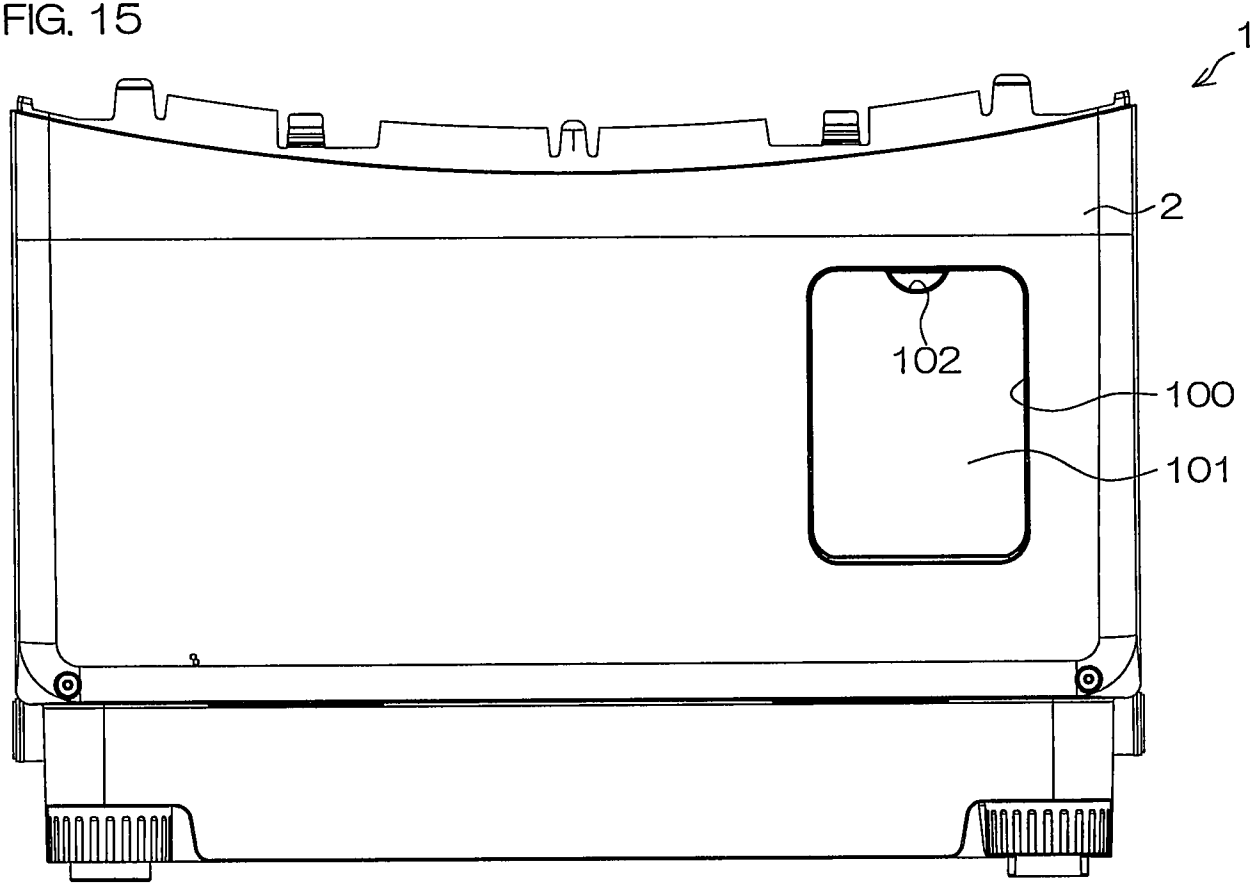
FIG. 15 is a partial front view of the washing/drying machine 1.

FIG. 15 is a partial front view of the washing/drying machine 1. The washing/drying machine 1 has a window 100 provided in a lower right portion of a front face of the housing 2 thereof. In this embodiment, the window 100 has a rectangular shape having rounded corners, but may have any shape. A cover 101 is attached to the window 100, so that the window 100 is covered and uncovered with the cover 101.

Figure 16:
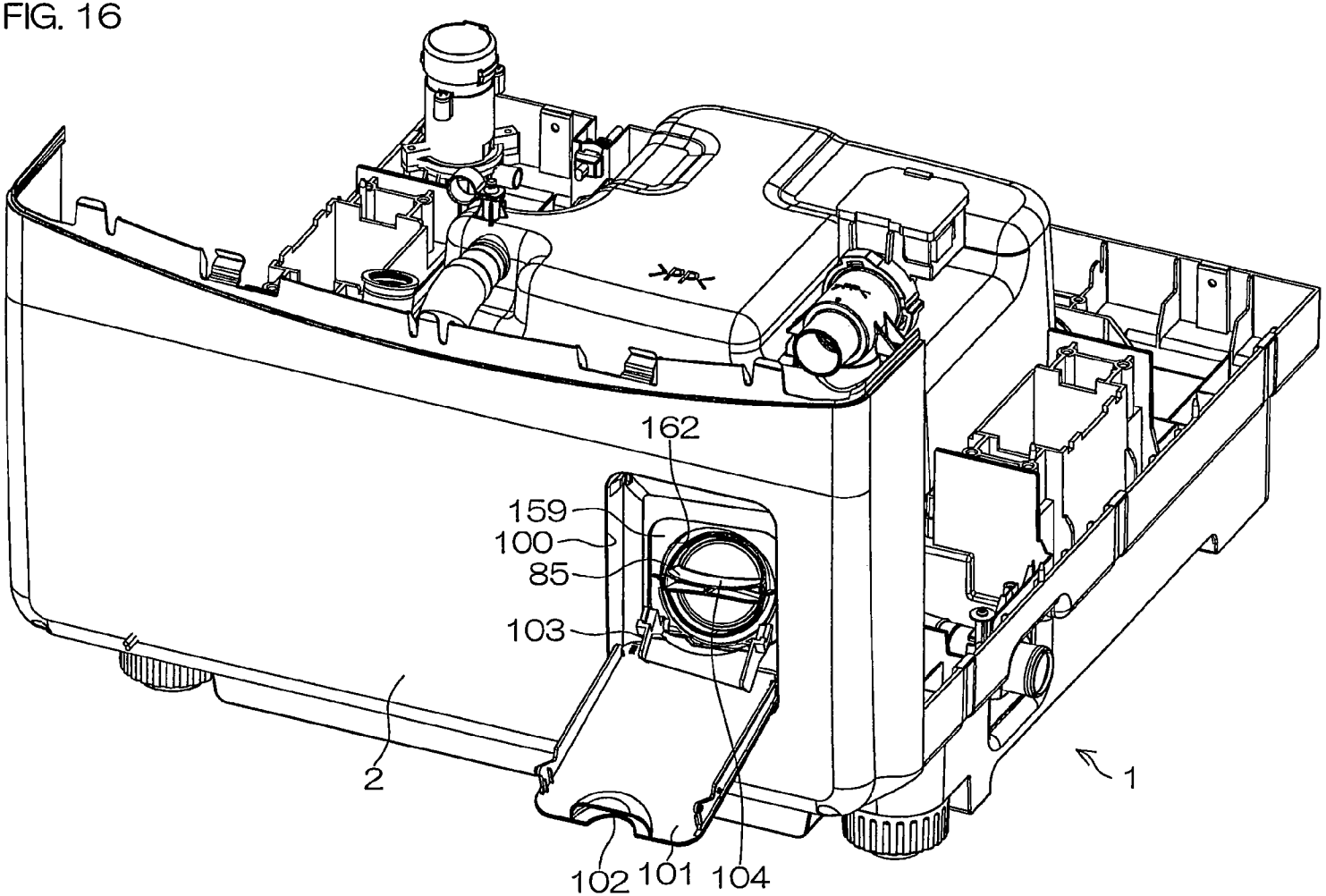
FIG. 16 is a partial perspective view of a lower portion of the washing/drying machine 1 as seen obliquely from the front side.

FIG. 16 is a partial perspective view of a lower portion of the washing/drying machine 1 as seen obliquely from the front side. As shown in FIG. 16, the cover 101 is pivotal forward about an axis extending between opposite lower ends, so that the cover 101 can be shifted from a window covering state as shown in FIG. 15 to a window uncovering state as shown in FIG. 16. For opening the cover 101, the user inserts his finger into a finger-hooking recess 102 formed in an upper edge portion of the cover 101 and pulls forward the cover 101.

With the cover 101 being open, the operable lid 85 of the filter unit 15 disposed behind the cover 101 is exposed. As described with reference to FIG. 8, the front fixture plate 159 of the case 150 is present around the operable lid 85 to close the inside of the window 100. Therefore, the entire structure of the filter unit 15 present behind the front fixture plate 159 cannot be seen through the window 100.

In this embodiment, a movable member 103 is provided between the cover 101 and the operable lid 85. When the cover 101 is opened as shown in FIG. 16, the movable member 103 is pivoted forward by its own weight. The movable member 103 pivoted forward does not hinder the operation of the operable lid 85. In this state, the operable lid 85 fitted in the filter insertion port 162 is turned left to be loosened, and then the filter body 83 is pulled forward. Thus, a maintenance operation can be performed on the filter body 83, for example, for removing foreign matter from the filter body 83, particularly, from the basket 84. After the maintenance operation, the basket 84 is inserted through the filter insertion port 162, and then the operable lid 85 is turned right. Thus, the filter body 83 is fitted in the case 150.

Figure 17:
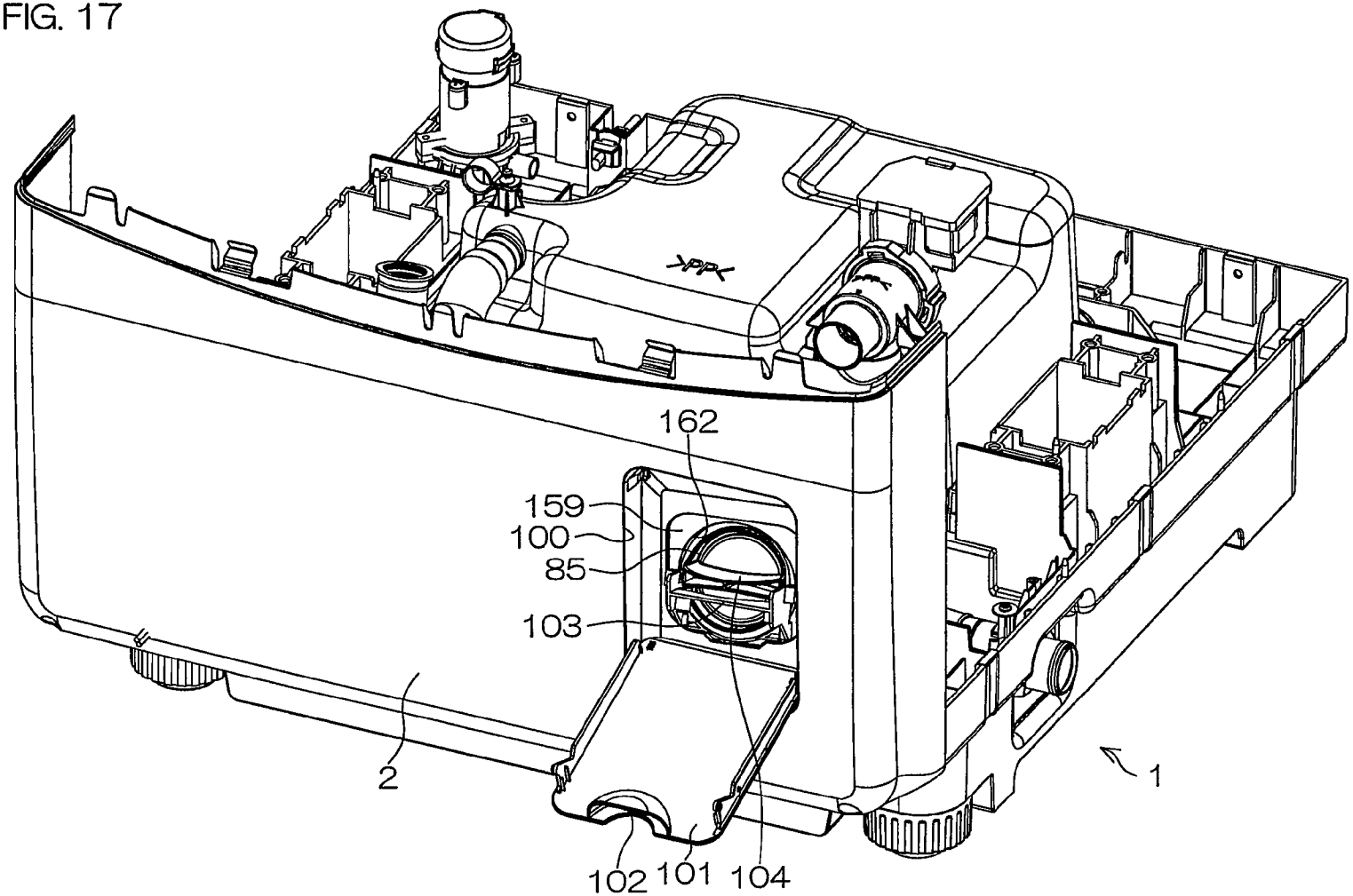
FIG. 17 is a partial perspective view of the lower portion of the washing/drying machine 1 as seen obliquely from the front side.

With the filter body 83 fitted in the case 150 and with the operable lid 85 properly turned, an operation rib 104 of the operable lid 85 is oriented horizontally. With the operation rib 104 oriented horizontally, as shown in FIG. 17, the movable member 103 can be pivoted upward. That is, the operation rib 104 of the operable lid 85 extends horizontally and, therefore, does not prevent the upward pivoting of the movable member 103. Thus, the movable member 103 can be pivoted upward.

Figure 18:
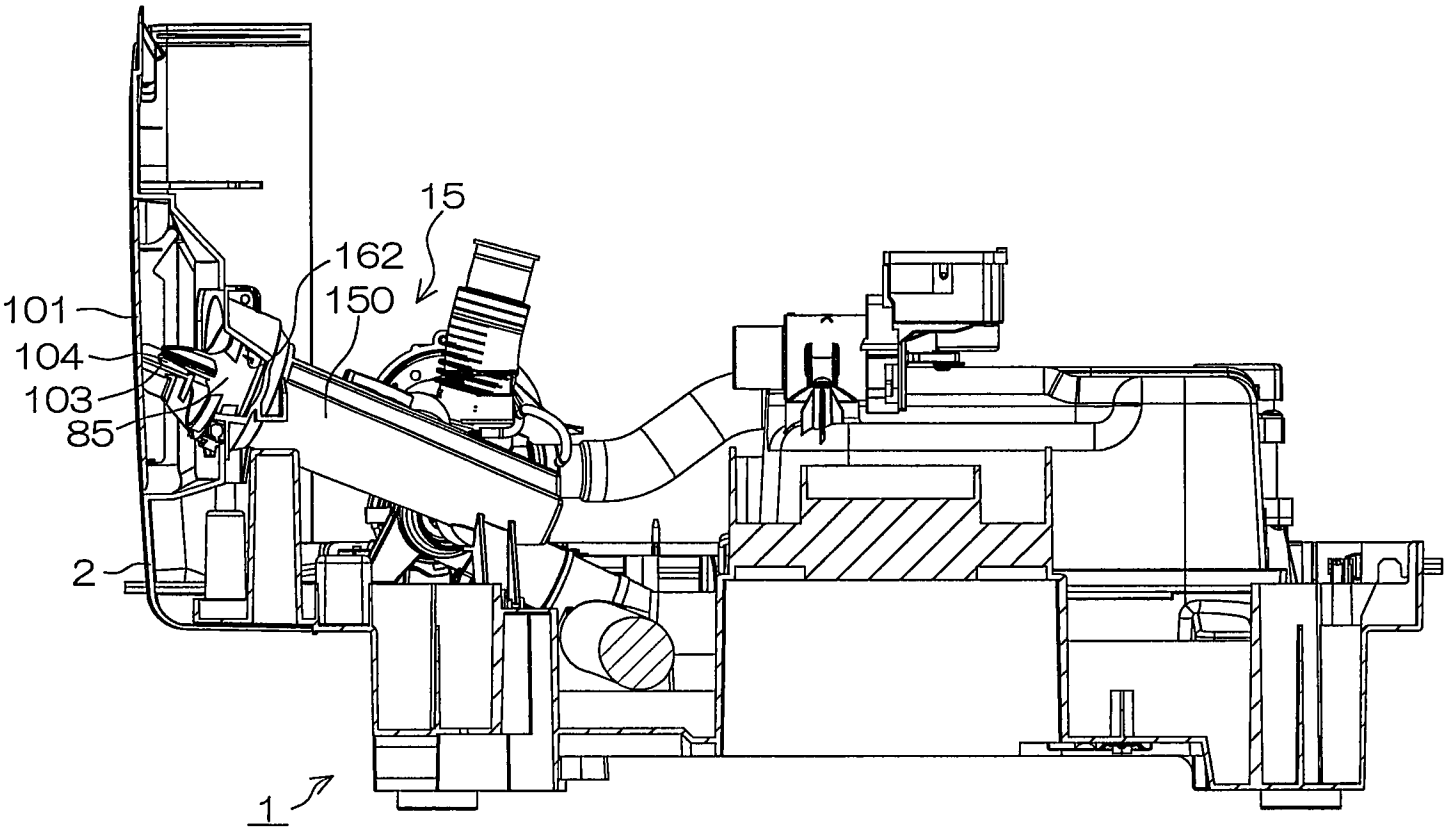
FIG. 18 is a right side partial sectional view of the lower portion of the washing/drying machine 1.

In general, as shown in FIG. 17, there is no need to intentionally pivot only the movable member 103 upward. By closing the cover 101 from the state shown in FIG. 16, the movable member 103 is pushed by an inner surface of the cover 101 to be pivoted upward. As shown in a right side partial sectional view of the lower portion of the washing/drying machine 1 of FIG. 18, the movable member 103 pivoted upward does not hinder the closing of the cover 101, but is flush with the front face of the housing 2 in a closed state.

Figure 19:
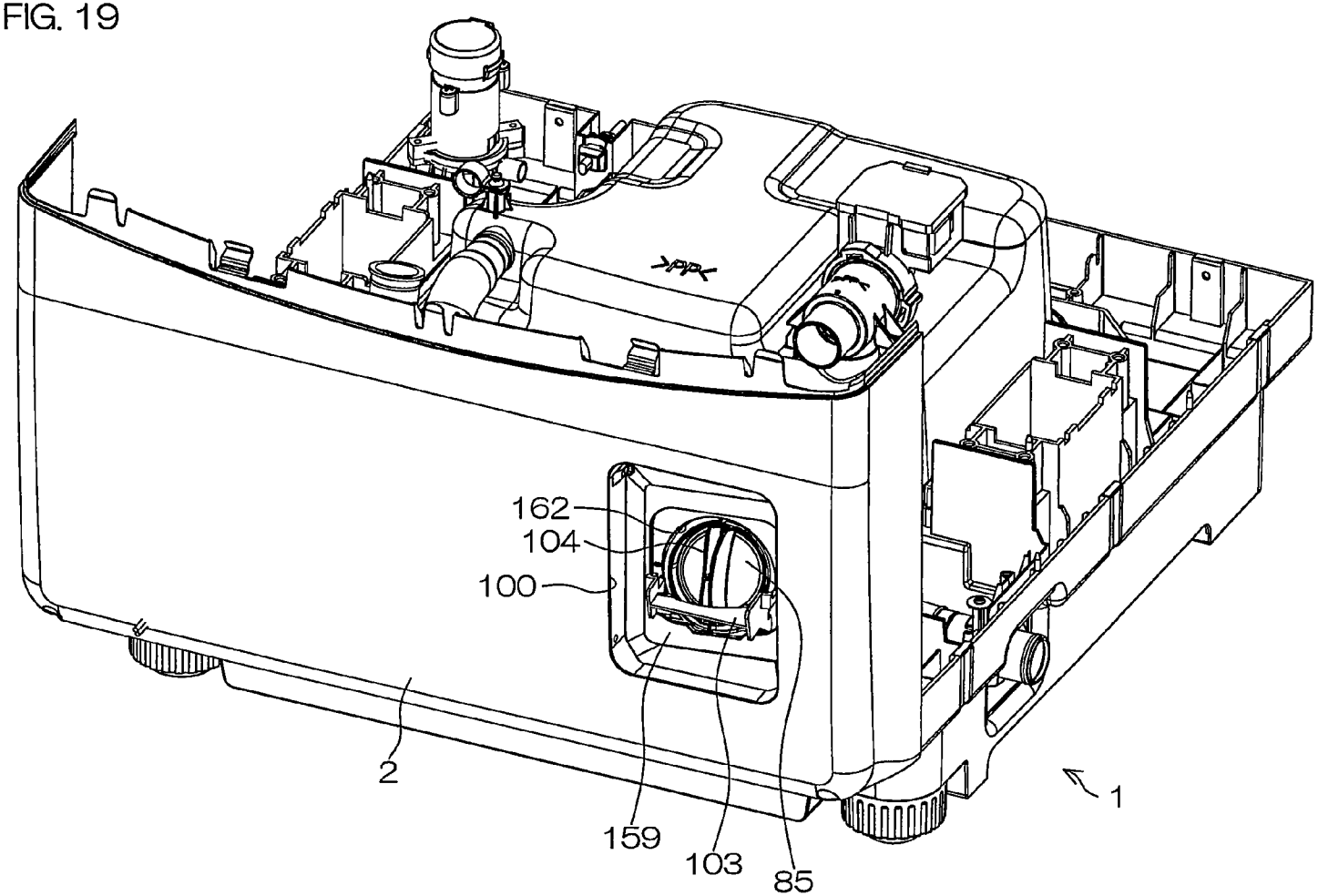
FIG. 19 is a partial perspective view of the lower portion of the washing/drying machine 1 as seen obliquely from the front side.

However, if the sealing between the filter insertion port 162 and the operable lid 85 is incomplete with the operable lid 85 improperly operated and incorrectly turned as shown in FIG. 19 and, therefore, water is likely to leak forward from the filter insertion port 162, the movable member 103 cannot be pivoted to a predetermined upper position.

Figure 20:
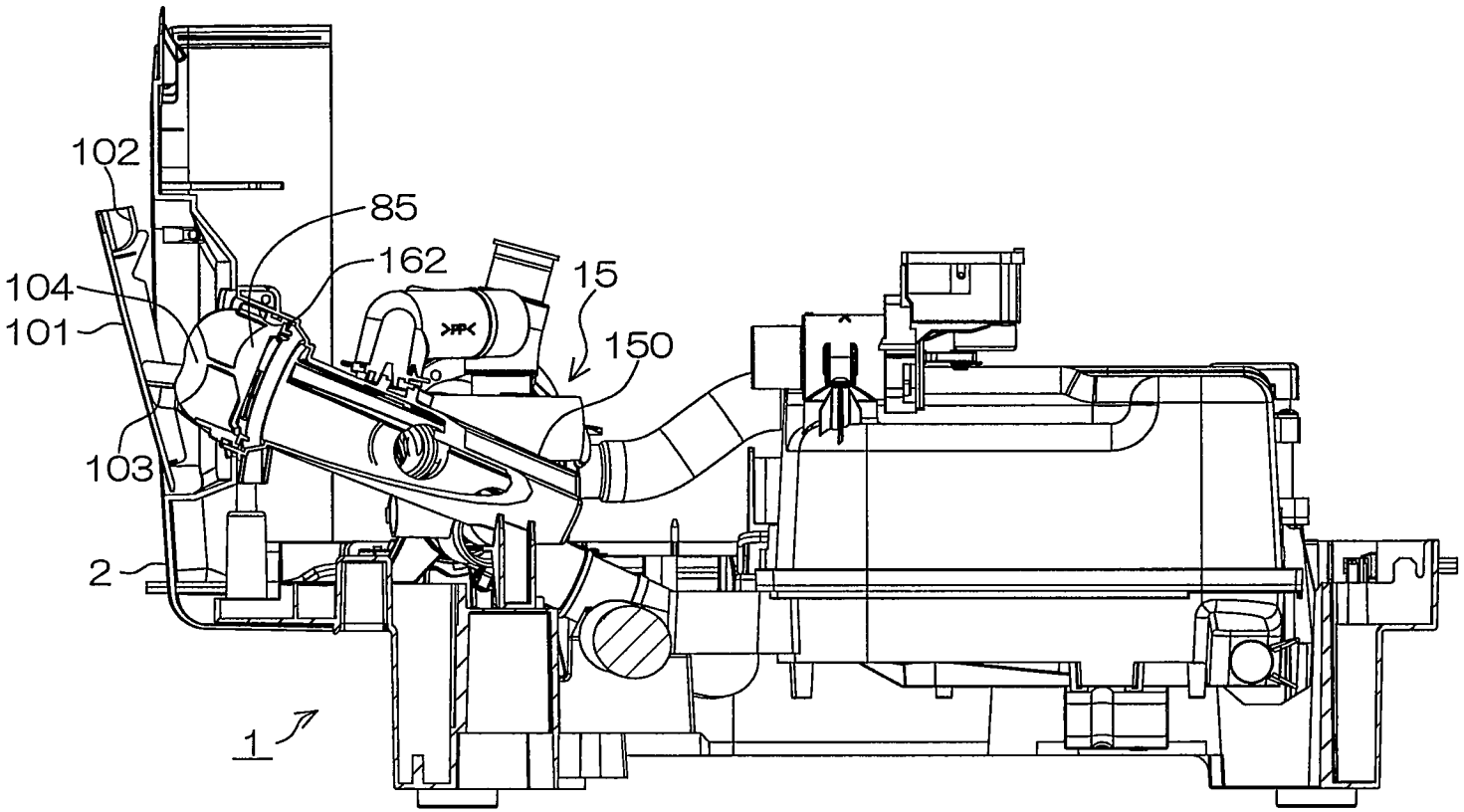
FIG. 20 is a right side view illustrating the lower portion of the washing/drying machine 1 partly in vertical section.

That is, if the operable lid 85 is not properly operated, the operation rib 104 is not oriented horizontally, but oriented vertically or obliquely with respect to the horizontal direction as shown in FIG. 19. In such a state, the operation rib 104 interferes with the movable member 103, making it impossible to pivot the movable member 103 to the predetermined upper position. As a result, the movable member 103 prevents the cover 101 from being completely closed as shown in a right side partial sectional view of the lower portion of the washing/drying machine 1 of FIG. 20. That is, the movable member 103 hits against the inner surface of the cover 101, making it impossible to close the cover 101.

If the user cannot close the cover 101, the user checks the state of the operable lid 85, and becomes aware that the operable lid 85 has been improperly operated.

If the operable lid 85 is not properly operated, the closing of the cover 101 is prevented. Thus, the user becomes aware that the user has improperly operated the operable lid 85 of the filter unit 15. This prevents the leak of the water from the filter unit 15.

Structure of Movable Member

FIGS. 21A, 21B and 21C are a plan view, a front view and a right side view showing a specific structure of the movable member 103, and FIGS. 21D and 21E are perspective views of the movable member 103 as seen obliquely from an upper side and a lower side, respectively.

Referring to FIGS. 21A to 21E, the movable member 103 includes a right arm plate 105 and a left arm plate 106 extending vertically and anteroposteriorly, and an interference plate 107 provided between the right arm plate 105 and the left arm plate 106 as extending transversely to connect the right arm plate 105 and the left arm plate 106 to each other. An engagement pivot boss 108 projects from a rear lower portion of the right arm plate 105 toward the left arm plate 106 (inward). Further, an engagement pivot boss 109 projects from a rear lower portion of the left arm plate 106 toward the right arm plate 105 (inward). The engagement pivot bosses 108, 109 align with each other. With the engagement pivot bosses 108, 109 fitted in engagement holes 114 of the front fixture plate 159 of the case 150 of the filter unit 15 (see FIG. 8), the movable member 103 is attached to the case 150 in a vertically pivotal manner.

The right arm plate 105 has a greater length than the left arm plate 106 as measured anteroposteriorly and, therefore, a distal end portion of the right arm plate 105 projects farther forward than a distal end portion of the left arm plate 106. Therefore, the interference plate 107 has a distal edge extending obliquely from the right to the left as seen in plan and, hence, has a width which is greater on the right side than on the left side. The interference plate 107 has a rear edge which is curved arcuately forward. Since the right arm plate 105 is greater in length than the left arm plate 106, only the distal end portion of the right arm plate 105 of the movable member 103 is brought into contact with the inner surface of the cover 101 (see FIG. 16). With the movable member 103 in contact with the inner surface of the cover 101 only at the distal end portion of the right arm plate 105, the movable member 103 is more smoothly pivoted correspondingly to the closing movement of the cover 101.

If the operable lid 85 is improperly operated, the interference plate 107 interferes with (or hits against) the operation rib 104 of the operable lid 85 to prevent the movable member 103 from being pivoted further upward. Reinforcement bars 110 are respectively provided at junctions between laterally opposite ends of the interference plate 107 and the right and left arm plates 105, 106 as extending perpendicularly to surfaces of the interference plate 107, the right arm plate 105 and the left arm plate 106 so as to prevent easy flexure and deformation of the interference plate 107 even if the interference plate 107 hits against the operation rib 104.

With the movable member 103 pivoted upward, the interference plate 107 is located in generally parallel adjacent relation to the operation rib 104 of the operable lid 85 to prevent the movement of the operation rib 104. Thus, the interference plate 107 functions to prevent the operable lid 85 from being turned to be loosened due to vibrations.

The movable member 103 is pivotal about the engagement support bosses 108, 109. Gravity center adjusting members 111 for adjusting the gravity center of the movable member 103 respectively project from outer surfaces of the right arm plate 105 and the left arm plate 106, so that the movable member 103 can be pivoted forward away from the operable lid 85 by its own weight, as described above, when the cover 101 is opened.

Further, a stopper projection 112 is provided adjacent the engagement pivot boss 108 so as to stop the movable member 103 at a predetermined pivoting angular position when the movable member 103 is pivoted forward about the engagement pivot bosses 108, 109. Referring to FIG. 16, when the movable member 103 is pivoted forward to the predetermined angular position, the stopper projection 112 abuts against the front fixture plate 159, for example, functioning to restrict the pivoting angular position of the movable member 103. This makes it possible to stop the movable member 103 at the predetermined angular position. Thus, the movable member 103 is prevented from being pivoted to hit against the cover 101. If the movable member 103 were adapted to stop in abutment against the cover 101, the movable member 103 would serve like a prop, making it difficult to close the cover 101.

Configuration of Control Circuit

Figure 22:
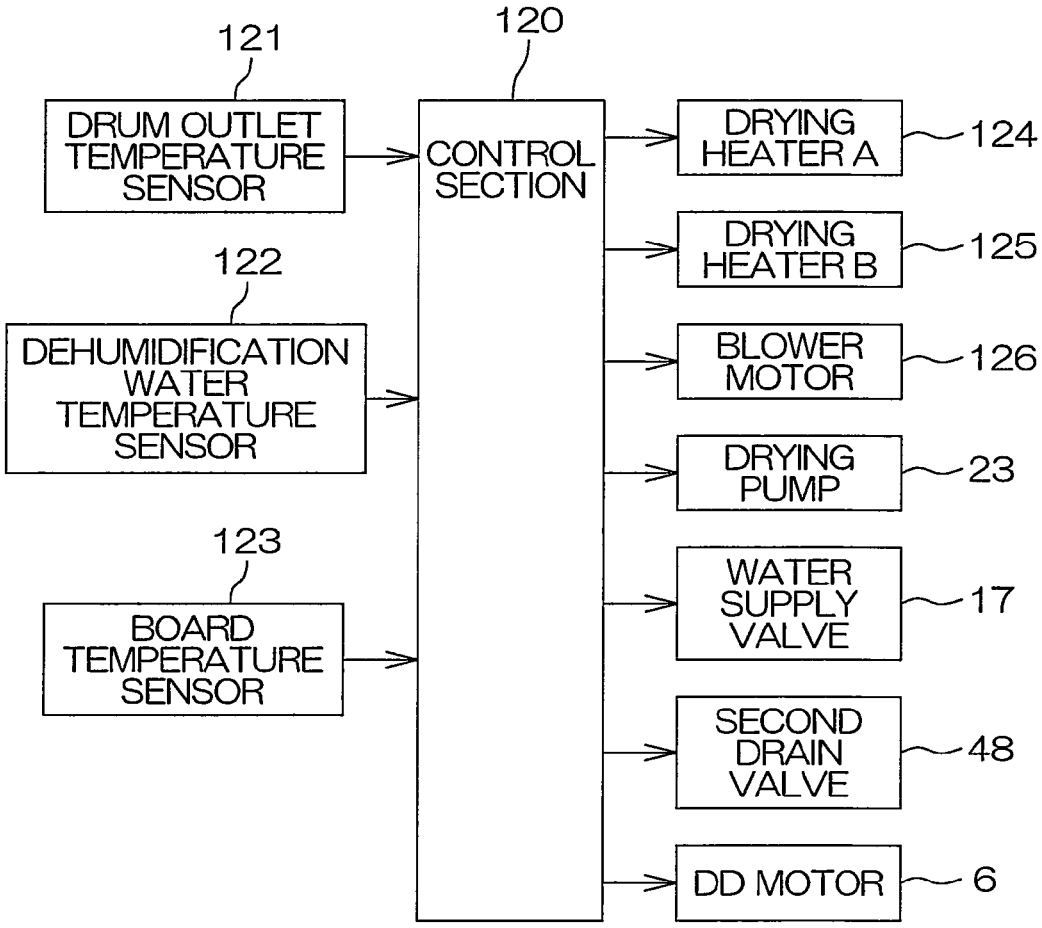
FIG. 22 is a block diagram for explaining the configuration of an electric control circuit of the washing/drying machine 1.

FIG. 22 is a block diagram for explaining the configuration of an electric control circuit of the washing/drying machine 1. In the block diagram of FIG. 22, only components required for performing the drying process in the washing/drying machine 1 are shown.

A control section 120 is a control center of the washing/drying machine 1, and includes a microcomputer and the like. The control section 120 is provided, for example, in the electrical component 12 (see FIG. 1).

Temperatures detected by the drum outlet temperature sensor 121, the dehumidification water temperature sensor 122 and the board temperature sensor 123 are inputted to the control section 120.

As described with reference to FIG. 3, the drum outlet temperature sensor 121 is disposed upstream of the blower 21 with respect to the air flow direction in the drying air duct 20. The drum outlet temperature sensor 121 detects the temperature of the air flowing out of the washing tub 3 and then through the drying air duct 20 and heat-exchanged with water in the drying air duct 20.

As described with reference to FIG. 3, the dehumidification water temperature sensor 122 is disposed at the lower end of the drying air duct 20 connected to the lower portion of the rear face of the outer tub 4. The dehumidification water temperature sensor 122 detects the temperature of the water heat-exchanged with the air flowing out of the washing tub in the drying air duct 20. At the start of the drying process, the dehumidification water temperature sensor 122 detects substantially the same temperature as the temperature of the water stored in the tank 11.

As described with reference to FIG. 1, the board temperature sensor 123 is disposed on a circuit board incorporated in the electrical component 12 disposed in the front lower portion of the housing 2. The board temperature sensor 123 detects an ambient temperature around the washing/drying machine 1 (a temperature proportional to a room temperature and generally equal to the room temperature plus 10° C.). At the start of the drying process, the temperature of the board does not rise and, therefore, the board temperature sensor 123 detects substantially the same temperature as the room temperature.

The drying heater A 124, the drying heater B 125, a blower motor 126, the drying pump 23, the water supply valve 17, the second drain valve 48 and the DD motor 6 are connected to the control section 120. The control section 120 controls the driving of these components connected thereto.

As described with reference to FIG. 1, the drying heater A 124 and the drying heater B 125 are disposed downstream of the blower 21 in the drying air duct 20 for heating the circulated air. The drying heater A 124 and the drying heater B 125 are, for example, semiconductor heaters, which have the same heat generation capacity in this embodiment. For control, whether either or both of the drying heaters 124, 125 are energized is determined according to the progress of the drying process as will be described later.

The blower motor 126 is driven for circulating the air through the drying air duct 20 in the drying process. The blower 21 is rotated by the blower motor 126.

The drying pump 23 is driven for circulating the water from the tank 11 through the drying air duct 20 in the drying process. As previously described, the water pumped up from the tank 11 by the drying pump 23 is supplied to the drying air duct 20 for the heat-exchange, the cooling and the cleaning. The supplied water flows down through the drying air duct 20 to be circulated from the drain port 42 of the outer tub 4 back into the tank 11 through the water passage 43, the first drain valve 44, the water passage 45, the filter unit 15, the storage water passage 62 and the water storage valve 63. Therefore, the volume of the tank 11 (or the amount of the water to be stored in the tank 11) is not necessarily required to be sufficient to store all the water to be supplied to the drying air duct 20 in the drying process, but the tank 11 may have a smaller volume. By circulating the water from the tank 11, the water saving can be achieved for the water supply in the drying process.

The water supply valve 17 is controlled to supply colder tap water as the heat exchange water instead of the recycling water circulated from the tank 11 at the final stage of the drying process.

The second drain valve 48 is controlled to drain the water from the tank 11 at the end of the drying process. The DD motor 6 is controlled to rotate the drum 5 of the washing tub 3.

Control Operation in Drying Process

Figure 23:
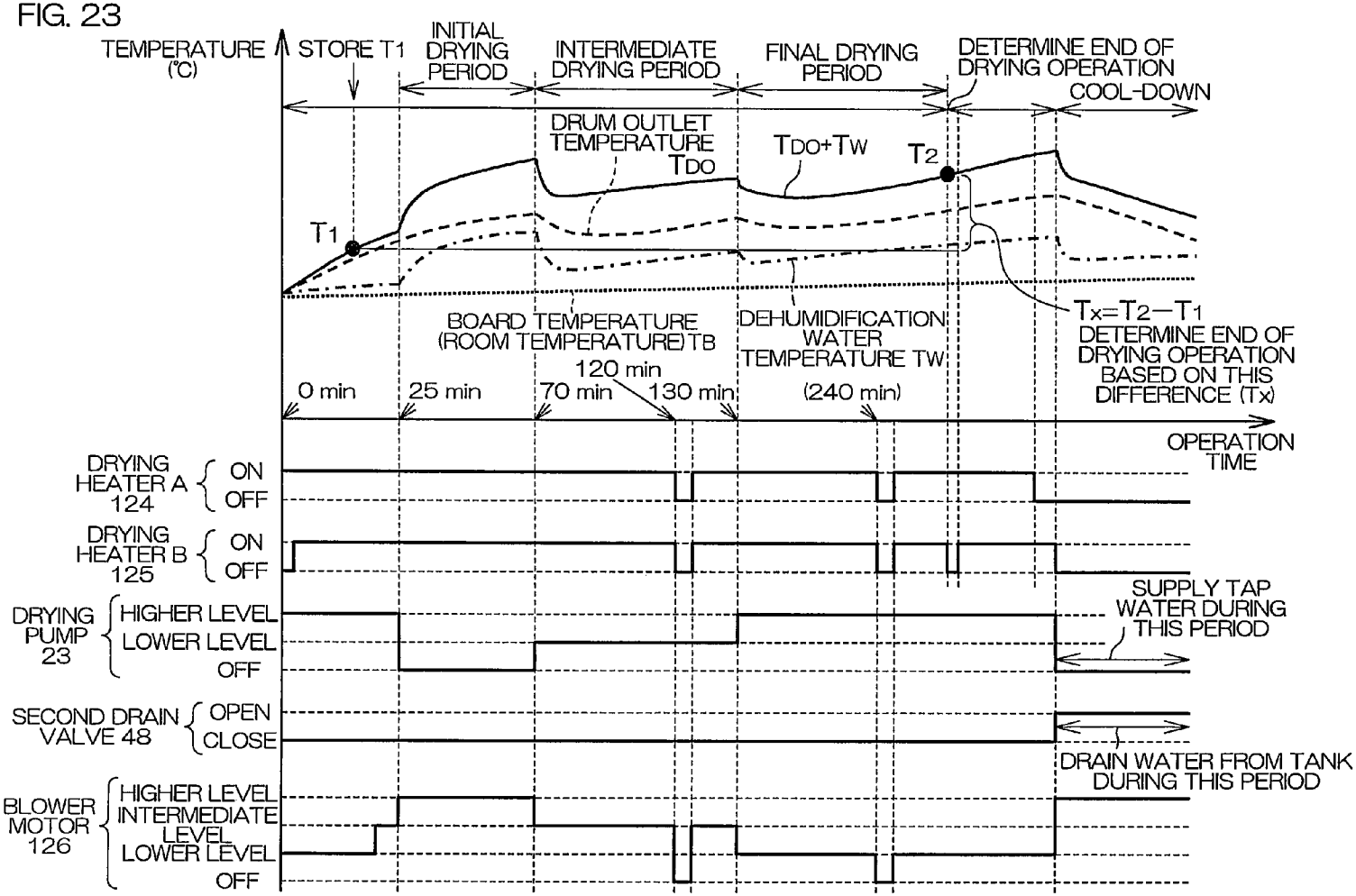
FIG. 23 is a timing chart for explaining operation control of the washing/drying machine 1 to be performed in a drying process.

FIG. 23 is a timing chart for explaining operation control of the washing/drying machine 1 to be performed in the drying process. With reference to the timing chart of FIG. 23, a control operation to be performed in the drying process in the washing/drying machine 1 will be described.

In the washing/drying machine 1, the drying heater A 124 is energized upon the start of the drying process, and the drying heater B 125 is energized, for example, with a delay of about 30 seconds. In order to suppress rush current, the two drying heaters 124, 125 are not simultaneously energized.

Further, the drying pump 23 is driven at a higher driving level. In order to check if water is stored in the tank 11, the drying pump 23 is driven at the higher driving level for a predetermined period upon the start of the drying process.

At the start of the drying process, the blower motor 126 is driven at a lower driving level. With the second drain valve 48 being closed, the water circulated from the tank 11 by the drying pump 23 is not drained to the external drain hose 50 (see FIG. 4) through the water passage 49.

At the start of the drying process, the drying heater A124, the drying heater B125, the drying pump 23 and the blower motor 126 are driven in the aforementioned manner, whereby the air from the washing tub 3 slowly flows through the drying air duct 20, and is heated by the drying heater A 124 and the drying heater B 125 and circulated into the washing tub 3. Since the circulated air is heated by energizing the two drying heaters 124, 125, a drum outlet temperature $T_{DO}$ detected by the drum outlet temperature sensor 121 is relatively steeply increased.

On the other hand, a dehumidification water temperature $T_w$ detected by the dehumidification water temperature sensor 122 is hardly increased, because the drying pump 23 is driven at the higher driving level to cause a greater amount of water to fall through the drying air duct 20 and the air flowing out of the washing tub 3 is not sufficiently heated.

In a drying startup period, this control state is continued, for example, for about 25 minutes. After a lapse of about 25 minutes from the start of the drying process, the driving of the blower motor 126 is switched from the lower driving level to an intermediate driving level and further to a higher driving level to increase the circulation rate of the air circulated through the drying air duct 20.

In an initial drying period from 25 minutes to 70 minutes after the start of the drying process, the drying heater A124 and the drying heater B125 are continuously energized, and the blower motor 126 is driven at the higher driving level. Further, the driving of the drying pump 23 is stopped. After the stop of the driving of the drying pump 23, the air circulated through the drying air duct 20 is not dehumidified, but heated by the drying heater A 124 and the drying heater B 125, so that the temperature of the circulated air, i.e., the drum outlet temperature $T_{DO}$ detected by the drum outlet temperature sensor 121, is increased.

On the other hand, the dehumidification water temperature sensor 122 does not detect the temperature of the dehumidification water, but mainly detects the moisture temperature of high-temperature high-humidity air flowing out of the washing tub 3, because the drying pump 23 is stopped. Since the air is heated, the detected dehumidification water temperature $T_W$ is steeply increased. In an intermediate drying period from 70 minutes to 130 minutes after the start of the drying process, the following control operation is performed.

The drying heater A 124 and the drying heater B 125 are continuously energized, and the driving of the blower motor 126 is switched to the intermediate level to slightly reduce the flow rate of the circulated air. Further, the drying pump 23 is driven at a lower driving level to circulate the water from the tank 11 for the heat exchange in the drying air duct 20. The drying pump 23 is driven to supply the dehumidification water from the tank 11 into the drying air duct 20, whereby the dehumidification water temperature $T_W$ detected by the dehumidification water temperature sensor 122 is steeply reduced and then gradually increased. This is because the heat of the circulated air is removed by the water due to the heat exchange between the water and the air in the drying air duct 20 to increase the temperature of the water.

The drum outlet temperature $T_{DO}$ detected by the drum outlet temperature sensor 121 is once reduced by the removal of the heat due to the heat exchange of the circulated air in a first half of the intermediate drying period, but the temperature of the circulated air is gradually increased with the gradual increase of the dehumidification water temperature.

The intermediate drying period ends, for example, after a lapse of 130 minutes from the start of the drying process, and is followed by a final drying period. An operation to be performed in the final drying period differs from the operation to be performed in the intermediate drying period in that the driving of the drying pump 23 is switched to the higher driving level and the driving of the blower motor 126 is switched to the lower driving level. The amount of the dehumidification water flowing through the drying air duct 20 is increased by driving the drying pump 23 at the higher driving level. In the final drying period, therefore, the dehumidification water temperature $T_W$ detected by the dehumidification water temperature sensor 122 is once reduced. However, the dehumidification water temperature is gradually increased by the continuous heat exchange between the dehumidification water and the circulated air. On the other hand, the flow rate of the air circulated through the drying air duct 20 is reduced because the driving of the blower motor 126 is switched to the lower driving level. Even if the temperature of the circulated air is reduced by the heat exchange, the drum outlet temperature $T_{DO}$ detected by the drum outlet temperature sensor 121 is generally leveled off and then gradually increased, because the circulated air is sufficiently heated by the drying heater A 124 and the drying heater B125.

In this embodiment, the drying heater A 124, the drying heater B 125 and the blower motor 126 are de-energized in synchronism for a predetermined period (e.g., 2 to 3 minutes) in the intermediate drying period and in the final drying period. A factor affecting the drying capability in the drying process is the temperature of the air circulated through the drying air duct 20, and it is desirable to keep the drum outlet temperature $T_{DO}$ at a predetermined higher temperature level. When the drying heater A 124 and the drying heater B 125 are de-energized in the drying process, the temperature of the circulated air (drum outlet temperature $T_{DO}$) is generally reduced. However, the circulation of the air is stopped by de-energizing the blower motor 126 in synchronism with the de-energization of the drying heater A 124 and the drying heater B 125. Thus, the temperature of the circulated air is not reduced, but kept at a generally constant level. In this embodiment, a control operation is performed so as to once de-energize the drying heater A 124, the drying heater B 125 and the blower motor 126 in synchronism for several minutes in the intermediate drying period and in the final drying period. Thus, the energy saving operation can be achieved without impairing the drying capability.

Next, how to determine the end of a drying operation in the drying process will be described. The drying period varies depending upon the amount and the type of the garment to be dried. Therefore, the end of the drying operation is not controlled based on the elapsed time, but automatically determined through a temperature-based control operation as will be described below.

In FIG. 23, a temperature curve $T_{DO}$ $T_W$ indicated by a solid line on an upper side represents a sum of the drum outlet temperature $T_{DO}$ and the dehumidification water temperature $T_w$. In this embodiment, a value of $T_{DO}$ $T_W$ is stored in a memory in the control section 120 after a lapse of 10 minutes from the start of the drying process. This temperature value is herein defined, for example, as $T_1$. Then, a value of $T_{DO}$ $T_W$ is monitored after a lapse of 120 or more minutes from the start of the drying process, and is defined as $T_2$. The end of the drying operation is determined when a difference $T_x=T_2-T_1$ between the temperatures $T_2$ and $T_1$ reaches a predetermined value.

A room temperature $T_B$ detected as the board temperature by the board temperature sensor 123 is generally constant during the drying process, but is gently increased by a temperature increase occurring due to the operation of the washing/drying machine 1.

In the washing/drying machine 1 according to this embodiment, the temperature of the circulated air heated by the drying heater A 124 and the drying heater B 125 (or the heat-exchanged circulated air) is detected as the drum outlet temperature $T_{DO}$ by the drum outlet temperature sensor 121. Further, the temperature of the circulated air is indirectly detected as the dehumidification water temperature $T_W$ by the dehumidification water temperature sensor 122. As the drying process progresses, these two temperatures $T_{DO}$, $T_W$ are increased. Therefore, the sum $T_2$ of the drum outlet temperature $T_{DO}$ and the dehumidification water temperature $T_W$ is drastically increased with the drying operation time. Therefore, the end of the drying operation can be relatively accurately determined by detecting an increase in the sum $T_2$. For reference, the determination of the end of the drying operation is based only on the temperature detected by the drum outlet temperature sensor 121 in the prior art.

Upon the determination of the end of the drying operation, the drying heater B 125 is once turned off as shown in FIG. 23. However, the turn-off of the drying heater B 125 is not necessarily required.

After a lapse of a predetermined period (e.g., 5 minutes) from the determination of the end of the drying operation based on the temperature difference $T_x=T_2-T_1$, the drying heater A 124 is first de-energized, and the drying heater B 125 is de-energized with a delay of several minutes. Simultaneously with the de-energization of the drying heater B 125, the drying pump 23 is stopped, and the second drain valve 48 is switched from a closed state to an open state. As a result, the water supplied from the tank 11 for the heat exchange is drained outside the machine through the water passage 49 and the external drain hose 50. The water can be entirely drained from the tank 11 by continuously driving the drying pump 23 for a short period of time after the opening of the second drain valve 48.

After the de-energization of the drying heater A124 and the drying heater B125, the driving of the blower motor 126 is switched to the higher driving level to increase the flow rate of the air circulated through the drying air duct 20 for a cool-down operation. The cool-down operation is performed for a predetermined period (e.g., about 10 minutes). The cool-down operation reduces the temperature of the garment dried in the washing tub 3. During the cool-down operation, the water supply valve 17 is preferably controlled to supply tap water into the drying air duct 20 through the water passage 39. Thus, the circulated air is heat-exchanged with the tap water during the cool-down operation to quickly reduce the temperature.

Figure 24:
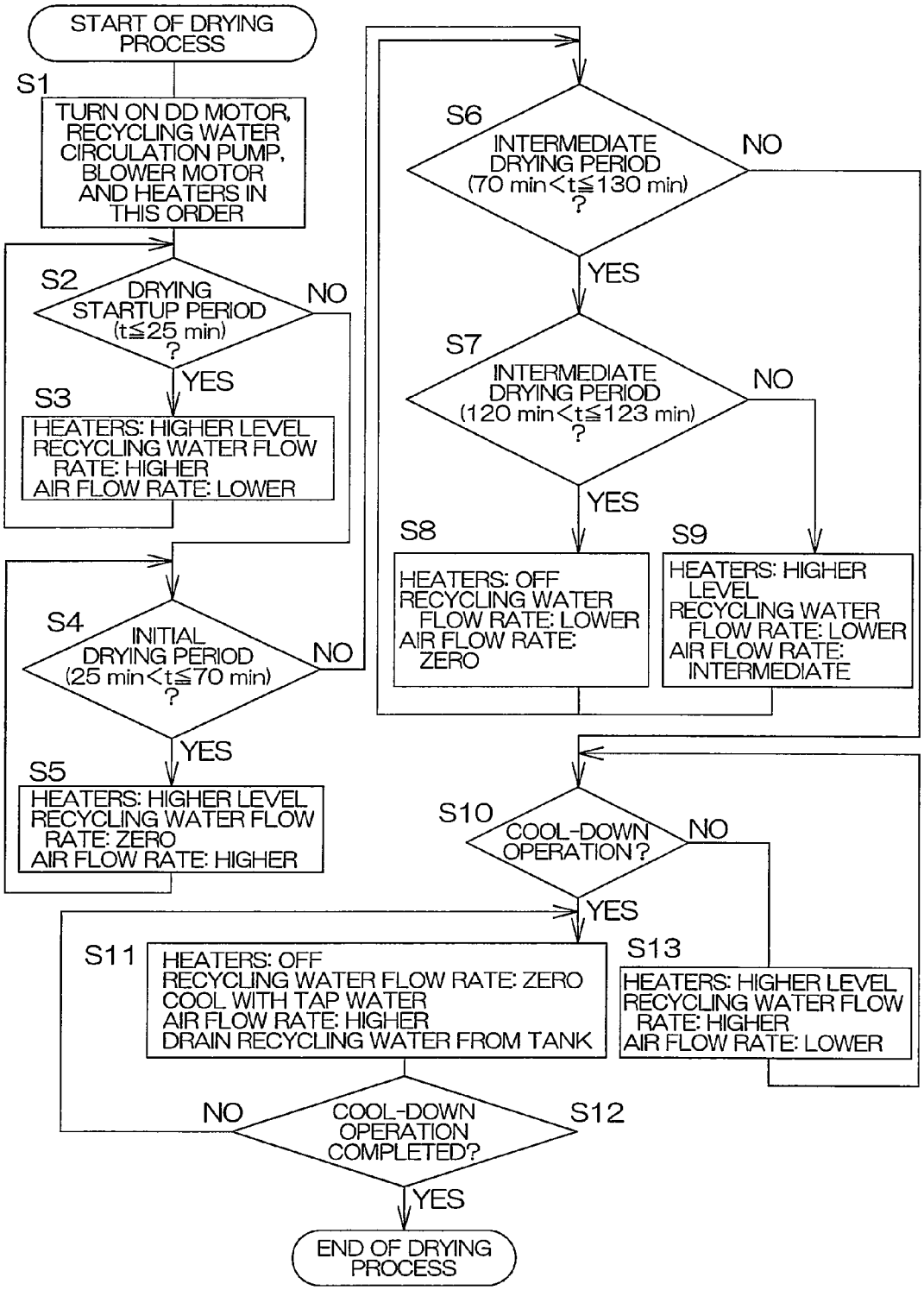
FIG. 24 is a control flow chart showing a control sequence to be performed in conformity with the timing chart shown in FIG. 23.

FIG. 24 is a control flowchart showing a control sequence to be performed in conformity with the timing chart shown in FIG. 23. The control sequence is performed by the control section 120 shown in FIG. 22.

With reference to FIG. 24, a control operation to be performed by the control section 120 in the drying process will be described.

Upon the start of the operation in the drying process, the control section 120 energizes the DD motor 6, the drying pump 23, the blower motor 126, the drying heater A 124 and the drying heater B 125 in this order (Step S1). Then, it is judged if the drying process is in the drying startup period, for example, before a lapse of 25 minutes after the start of the operation (Step S2). In the drying startup period, the two drying heaters 124, 125 are both energized to be driven at the higher driving level. The drying pump 23 is also driven at the higher driving level to circulate the cooling water at a higher flow rate. On the other hand, the blower motor 126 is driven at the lower driving level to circulate the air at a lower flow rate (Step S3).

The drying startup period ends and, in the initial drying period from 25 minutes to 70 minutes after the start of the drying process (YES in Step S4), the two drying heaters 124, 125 are kept energized. Further, the drying pump 23 is stopped to stop the circulation of the water from the tank 11, and the blower motor 126 is driven at the higher driving level (Step S5). Thus, the air in the washing tub 3 is quickly heated, so that the air temperature is increased in a short period of time. This control operation is efficient for the drying, thereby reducing the drying period.

In turn, it is judged if the drying process is in the intermediate drying period from 70 minutes to 130 minutes after the start of the drying process (Step S6). If the drying process is in the intermediate drying period, it is judged if time elapsed after the start of the drying process is from 120 minutes to 123 minutes (Step S7). Immediately after the start of the intermediate drying period, the control operation is performed through Steps S6, S7 and S9. That is, the two drying heaters 124, 125 are kept energized to be driven at the higher driving level, and the drying pump 23 is driven at the lower driving level to circulate the recycling water at a lower flow rate. Further, the blower motor 126 is driven at the intermediate driving level to circulate the air at an intermediate flow rate (Step S9). Thus, the circulated air is quickly heated to steeply increase the temperature of the air in the washing tub 3, whereby the drying of the garment is promoted for reduction of the drying operation period.

If the result of the judgment in Step S7 is YES in the intermediate drying period, the energization of the two drying heaters A124, B125 and the blower motor 126 are interrupted in synchronism (Step S8). The interruption of the energization of the heaters 124, 125 and the blower motor 126 makes it possible to achieve the energy saving in performing the drying process substantially without reduction in the temperature of the air in the drying air duct 20.

In turn, the control operation is performed through Step S10 and, if it is judged that the cool-down operation is performed, the two drying heaters A124, B125 are de-energized. Further, the driving of the drying pump 23 is stopped, and the tap water is supplied as the dehumidification water into the drying air duct 20 by the water supply valve 17. Then, the blower motor 126 is driven at the higher driving level to circulate the air at an increased flow rate. Thus, the heated air is rapidly circulated from the washing tub 3 to be thereby cooled. This correspondingly reduces the temperature of the garment in the washing tub 3 (Step S11).

If it is judged that the cool-down operation ends after being performed for a predetermined period (Step S12), the drying process ends.

If it is judged in Step S10 that the cool-down operation is not performed, the two drying heaters 124, 125 are kept energized, and the drying pump 23 is driven at the higher driving level to supply a greater amount of water into the drying air duct 20. Further, the driving of the blower motor 126 is switched to the lower driving level to circulate the air at a reduced flow rate (Step S13). By supplying the greater amount of water into the drying air duct 20 by means of the drying pump 23, foreign matter such as lint adhering to the inner surface of the drying air duct 20 is washed away. Thus, the drying air duct is cleaned at the end of the drying process.

Figure 25:
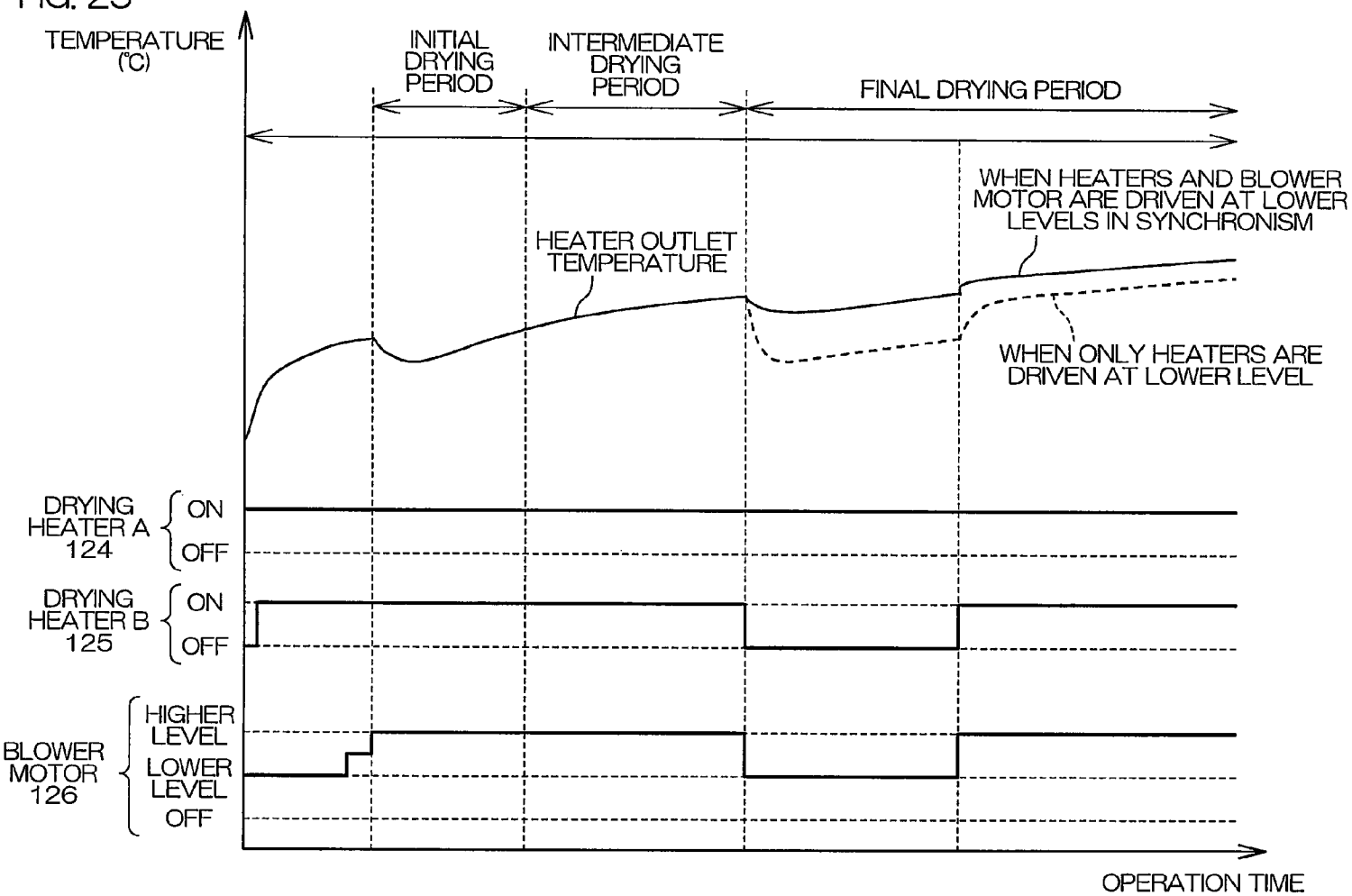
FIG. 25 is a timing chart showing a modification of the drying operation control to be performed in the drying process.

FIG. 25 is a timing chart showing a modification of the drying control to be performed in the drying process. In the timing chart of FIG. 25, the temperature of the air heated by the drying heater A 124 and the drying heater B 125 is defined as a heater outlet temperature, and indicated by a solid line on an upper side. Below the air temperature curve, the energization states of the drying heater A 124 and the drying heater B 125 and the driving state of the blower motor 126 are shown.

The change in heater outlet temperature herein shown is affected only by the drying heater A 124 and the drying heater B 125, but not by the heat exchange between the circulated air and the cooling water.

When the two drying heaters 124, 125 are energized with a time lag and the blower motor 126 is driven at the lower driving level after the start of the drying process, the heater outlet temperature is steeply increased. When the driving of the blower motor 126 is switched from the lower driving level to the higher driving level to increase the flow rate of the air circulated through the drying air duct 20 in the initial drying period, the heater outlet temperature is once reduced and then gradually increased with the drying operation time. In the timing chart of FIG. 25, when the final drying period is started following the intermediate drying period, one of the two drying heaters, i.e., the drying heater B125, is de-energized for a predetermined period (e.g., several minutes to about 10 minutes). At the same time, the blower motor 126 is driven at the lower driving level. By thus driving the blower motor 126 at the lower driving level in synchronism with the de-energization of the drying heater B 125, the drying process can be continuously performed without substantial change in heater outlet temperature in the final drying period as shown in FIG. 25.

For reference, a temperature change observed when only the drying heater B 125 is de-energized and the blower motor 126 is continuously driven at the higher driving level is shown by a broken line. If only the drying heater B 125 is once de-energized, the heater outlet temperature (drying air temperature) is significantly reduced. The significant reduction in air temperature reduces the drying efficiency, thereby increasing the drying period. By switching the driving of the blower motor 126 to the lower driving level in synchronism with the switching of the drying heaters to the lower driving level as in this embodiment, the electric energy consumption is reduced without reduction in drying air temperature, thereby achieving the energy saving operation.

Figure 26:
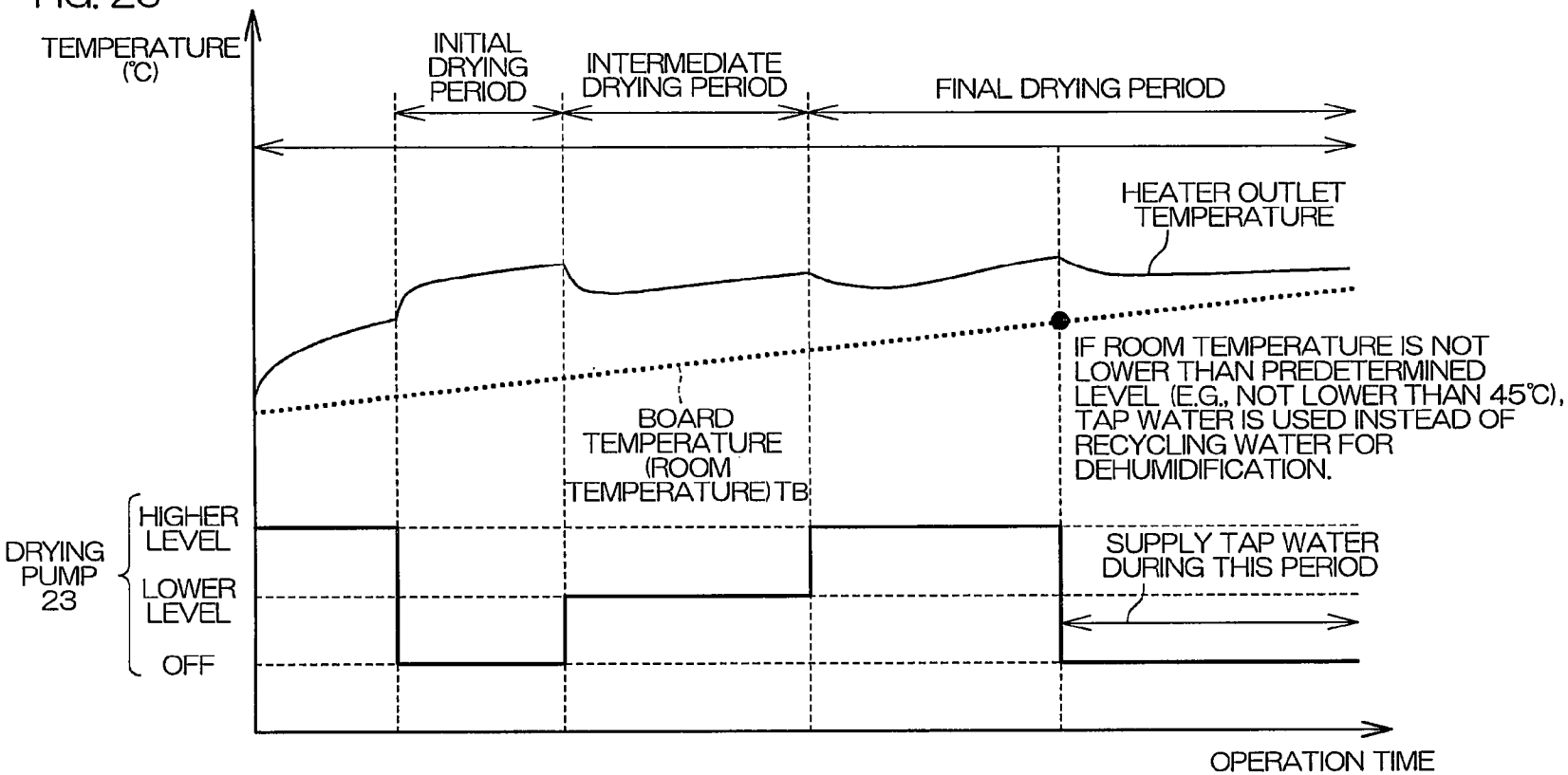
FIG. 26 is a timing chart showing another modification of the drying operation control to be performed in the drying process.

FIG. 26 shows another modification of the control to be performed in the drying process. In FIG. 26, the heater outlet temperature (the temperature of the circulated air to be supplied into the washing tub 3 after passing through the drying heater A 124 and the drying heater B 125) is indicated by a solid line on an upper side, and the board temperature (room temperature) $T_B$ gradually increased in the drying process is shown below the heater outlet temperature curve. In general, the board temperature is proportional to the room temperature, and is generally equal to the room temperature plus 10° C. The board temperature $T_B$ is gently increased with the drying operation time.

During the drying operation, the air circulated through the drying air duct 20 needs to be dehumidified and cooled. For this purpose, the drying pump 23 is driven to circulate the water from the tank 11. As previously described, the drying pump 23 is driven at the higher driving level in the drying startup period to check if the water is stored in the tank 11. In the initial drying period, the driving of the drying pump 23 is stopped mainly for increasing the heater outlet temperature (the temperature of the circulated air). In the intermediate drying period, the drying pump 23 is driven at the lower driving level to dehumidify the circulated drying air. In the final drying period, the drying pump 23 is driven at the higher driving level, whereby the heat exchange with the air is promoted to increase the drying efficiency.

In the control operation of FIG. 26, when the board temperature $T_B$ is not lower than a predetermined temperature level, e.g., not lower than 45° C., in the final drying period, the tap water is supplied instead of the water fed from the tank 11 for the dehumidification of the drying air circulated through the drying air duct. Therefore, when the detected board temperature $T_B$ is not lower than the predetermined temperature, the driving of the drying pump 23 is stopped, and the water supply valve 17 is switched to supply the tap water into the drying air duct 20. This slightly reduces the temperature of the air circulated through the drying air duct 20, but improves the efficiency of the dehumidification of the circulated air, thereby reducing the drying period.

The present invention is not limited to the embodiment described above, but various modifications may be made within the scope of the appended claims.

What is claimed is:

1. A washing/drying machine comprising:

a washing tub;

a tank for storing used water;

a drying air duct disposed outside the washing tub and having opposite ends connected to the washing tub for use in a drying process;

air blowing/heating means provided in the drying air duct for sucking air out of the washing tub through one of the opposite ends of the drying air duct, heating the sucked air and feeding the heated air back into the washing tub through the other end of the drying air duct in the drying process;

a tank water circulation passage including a supply passage having opposite ends, one of which is connected to the tank and the other of which is connected to a first position of the drying air duct, and a recovery passage having opposite ends, one of which is connected to a second position of the drying air duct or the washing tub and the other of which is connected to the tank;

a pump provided in the tank water circulation passage for pumping up the water from the tank through the supply passage to supply the water into the drying air duct from the first position and causing the water to fall through the drying air duct to feed the water back into the tank through the recovery passage from the second position or the washing tub to circulate the water; and control means which controls driving of the pump so as to circulate a smaller amount of water through the tank water circulation passage in a first half of the drying process and circulate a greater amount of water through the tank water circulation passage in a second half of the drying process;

wherein the control means controls the driving of the pump so that the amount of the water to be circulated through the tank water circulation passage in the first half of the drying process is great enough to be comparable with the amount of the water to be circulated through the tank water circulation passage in the second half of the drying process, if a temperature of the water contained in the tank is lower by at least a predetermined degree than a room temperature at start of the drying process.

2. The washing/drying machine according to claim 1, further comprising:

a temperature sensor which detects an ambient temperature around the washing/drying machine; and tap water supply means which, when a temperature higher than a predetermined level is detected by the temperature sensor, stops the driving of the pump and supplies tap water to a predetermined position in the drying air duct.

3. The washing/drying machine according to claim 1, further comprising tap water supply means which stops the driving of the pump and supplies tap water to a predetermined position in the drying air duct during a cool-down operation at end of the drying process.

4. The washing/drying machine according to claim 1, further comprising interruption control means which deactuates the air blowing/heating means for a predetermined period in the drying process.

5. The washing/drying machine according to claim 1, further comprising:

an air temperature sensor provided in the drying air duct for detecting a temperature of the circulated air after heat exchange with the water supplied into the drying air duct;

a water temperature sensor which detects a temperature of the water supplied into the drying air duct and heat-exchanged with the circulated air; and control means which performs a drying termination control operation based on a change in a sum of the temperatures detected by the air temperature sensor and the water temperature sensor.

6. The washing/drying machine according to claim 1, further comprising drain means which drains the water from the tank during a cool-down operation at end of the drying process.

7. The washing/drying machine according to claim 1, further comprising:

temperature detection means which detects a temperature of the air circulated through the drying air duct; and control means which controls driving of the air blowing/heating means based on the temperature detected by the temperature detection means.

8. A washing/drying machine comprising:

a washing tub;

a tank having a smaller internal volume for storing water used in one of a plurality of rinsing steps;

a drying air duct disposed outside the washing tub and having opposite ends connected to the washing tub for use in a drying process;

air blowing/heating means provided in the drying air duct for sucking air out of the washing tub through one of the opposite ends of the drying air duct, heating the sucked air and feeding the heated air back into the washing tub through the other end of the drying air duct in the drying process;

a tank water circulation passage including a supply passage having opposite ends, one of which is connected to the tank and the other of which is connected to a first position of the drying air duct, and a recovery passage having opposite ends, one of which is connected to a second position of the drying air duct or the washing tub and the other of which is connected to the tank;

a pump provided in the tank water circulation passage for pumping up the water from the tank through the supply passage to supply the water into the drying air duct from the first position and causing the water to fall through the drying air duct to feed the water back into the tank through the recovery passage from the second position or the washing tub to circulate the water; and control means which controls driving of the pump so as to circulate a smaller amount of water through the tank water circulation passage in a first half of the drying process and circulate a greater amount of water through the tank water circulation passage in a second half of the drying process;

wherein the control means controls the driving of the pump so that the amount of the water to be circulated through the tank water circulation passage in the first half of the drying process is great enough to be comparable with the amount of the water to be circulated through the tank water circulation passage in the second half of the drying process, if a temperature of the water contained in the tank is lower by at least a predetermined degree than a room temperature at start of the drying process.

9. A washing/drying machine comprising:

a washing tub;

a tank having a smaller internal volume for storing water used in one of a plurality of rinsing steps;

a drying air duct disposed outside the washing tub and having opposite ends connected to the washing tub for use in a drying process;

air blowing/heating means provided in the drying air duct for sucking air out of the washing tub through one of the opposite ends of the drying air duct, heating the sucked air and feeding the heated air back into the washing tub through the other end of the drying air duct in the drying process;

a tank water circulation passage including a supply passage having opposite ends, one of which is connected to the tank and the other of which is connected to a first position of the drying air duct, and a recovery passage having opposite ends, one of which is connected to a second position of the drying air duct or the washing tub and the other of which is connected to the tank; and a pump provided in the tank water circulation passage for pumping up the water from the tank through the supply passage to supply the water into the drying air duct from the first position and causing the water to fall through the drying air duct to feed the water back into the tank through the recovery passage from the second position or the washing tub to circulate the water; and control means which controls driving of the pump so as to circulate a smaller amount of water through the tank water circulation passage in a first half of the drying process and circulate a greater amount of water through the tank water circulation passage in a second half of the drying process;

wherein the control means controls the driving of the pump so that the amount of the water to be circulated through the tank water circulation passage in the first half of the drying process is great enough to be comparable with the amount of the water to be circulated through the tank water circulation passage in the second half of the drying process, if a temperature of the water contained in the tank is lower by at least a predetermined degree than a room temperature at start of the drying process.

* * * * *